US007394342B2

(12) United States Patent
Kawai et al.

(10) Patent No.: US 7,394,342 B2
(45) Date of Patent: Jul. 1, 2008

(54) IGNITION COIL AND MANUFACTURING METHOD AND APPARATUS THEREOF

(75) Inventors: Kazuhide Kawai, Kariya (JP); Shoji Takahashi, Inabe (JP); Chihiro Ikedo, Wuxi (CN)

(73) Assignee: Denso Corporation (JP)

( * ) Notice: Subject to any disclaimer, the term of this patent is extended or adjusted under 35 U.S.C. 154(b) by 99 days.

(21) Appl. No.: 11/505,891

(22) Filed: Aug. 18, 2006

(65) Prior Publication Data

US 2007/0040641 A1 Feb. 22, 2007

(30) Foreign Application Priority Data

Aug. 19, 2005 (JP) ..... 2005-238870
May 9, 2006 (JP) ..... 2006-130655

(51) Int. Cl.
*H01F 27/24* (2006.01)

(52) U.S. Cl. ..... 336/219

(58) Field of Classification Search ..... 336/65, 336/83, 90, 92, 96, 107, 192, 212, 219, 233–234; 123/634–635
See application file for complete search history.

(56) References Cited

U.S. PATENT DOCUMENTS 2,746,020 A * 5/1956 Lantenberger ..... 336/55
6,005,468 A * 12/1999 Shirahata et al. ..... 336/212
6,208,231 B1 * 3/2001 Oosuka et al. ..... 336/107
6,980,073 B2 12/2005 Wada
7,053,746 B2 * 5/2006 Widiger et al. ..... 336/90

FOREIGN PATENT DOCUMENTS

JP 09186034 A * 7/1997
JP 10-092670 4/1998
JP 10092670 A * 4/1998
JP 2004-111714 4/2004

* cited by examiner

*Primary Examiner*—Tuyen T. Nguyen
(74) *Attorney, Agent, or Firm*—Nixon & Vanderhye PC

(57) ABSTRACT

An axial end portion of a dielectric sheet, which is wound around a central core of an ignition coil, includes an axially projecting portion, which projects from an axial end surface of the central core positioned radially inward of primary and secondary coils in a case. An inner peripheral side axial end corner and an outer peripheral side axial end corner in the axially projecting portion are respectively formed into a blunt smooth round shape. Dielectric resin is filled in spaces in the case. Alternatively, the axially projecting portion may have a folded end portion, which includes a plurality of generally arcuate segments folded one after another on one circumferential side thereof.

5 Claims, 21 Drawing Sheets

IGNITION COIL AND MANUFACTURING METHOD AND APPARATUS THEREOF

CROSS REFERENCE TO RELATED APPLICATION

This application is based on and incorporates herein by reference Japanese Patent Application No. 2005-238870 filed on Aug. 19, 2005 and Japanese Patent Application No. 2006-130655 filed on May 9, 2006.

BACKGROUND OF THE INVENTION

1. Field of the Invention

The present invention relates to an ignition coil, which is used to generate a spark from a spark plug of an internal combustion engine, and a manufacturing method and a manufacturing apparatus for manufacturing such an ignition coil.

2. Description of Related Art

An ignition coil, which is used to generate a spark from a spark plug in an internal combustion engine of, for example, a vehicle, includes a primary coil and a secondary coil arranged in a coil case. Furthermore, a central core, which is made of a magnetic steel plate(s), is arranged radially inward of the primary coil and the secondary coil. A dielectric sheet, which serves as a thermal stress relief member, is wound around an outer peripheral surface of the central core. The dielectric sheet protects the dielectric resin, which is filled in spaces in the coil case, from thermal stress that is applied by the heating and cooling cycle of the engine.

The above described type of ignition coil, which includes the dielectric sheet wound around the central core, is disclosed in, for example, Japanese Unexamined Patent Publication No. H10-92670, Japanese Unexamined Patent Publication No. 2004-14548 (corresponding to U.S. Pat. No. 6,980,073) and Japanese Unexamined Patent Publication Number 2004-111714.

In Japanese Unexamined Patent Publication No. H10-92670, the dielectric sheet is interposed between a central iron core (i.e., the central core) and a secondary winding core (i.e., a spool around which a secondary coil is wound). Here, even if an air bubble is generated in the secondary winding core, which is made of thermoplastic resin, the electric insulation between the central iron core and the secondary coil is maintained by the dielectric sheet.

In Japanese Unexamined Patent Publication No. 2004-14548, the thickness of the dielectric sheet, which is wound around the central core and serves as the thermal stress relief member, is set to an appropriate thickness. In this way, formation of a crack in the dielectric resin, which is filled in the space between the central core and the cylindrical spool, is limited.

In Japanese Unexamined Patent publication No. 2004-111714, a cover member (gel) is applied to an entire length of a winding end of the dielectric sheet, which is wound around the outer peripheral surface of the central core and serves as the thermal stress relief member, so that unintentional removal and radially outward protrusion of the winding end of the dielectric sheet from the central core are limited. When the winding end of the dielectric sheet projects from the central core, stress concentration occurs in the winding end of the dielectric sheet, and a crack is generated due to thermal stress in the dielectric resin filled in the space between the central core and the coil. However, the unintentional projection of the winding end of the dielectric sheet from the central core is advantageously limited by the cover member.

Furthermore, in some previously propose cases, as shown in FIGS. 28-30, a dielectric sheet 94 is wound around a central core 923 in such a manner that an axial end portion 941 of the dielectric sheet 94 projects from an axial end surface 924 of the central core 923 to limit generation of a crack in dielectric resin 911, which contacts the axial end surface 924 of the central core 923.

However, when the dielectric sheet 94 is wound multiple times around the central core 923, axial end portions 941 of layered dielectric sheet constituent sections 940 of the dielectric sheet 94 may possibly be displaced from one another in the axial direction, so that steps 942 are formed at the axial end portions 941 of the layered dielectric sheet constituent sections 940 of the dielectric sheet 94. In such a case, as shown in FIG. 30, edged grooves (sharp grooves) 912 are formed in the dielectric resin 911 that is filled in the coil case in contact with the axial end portions 941 of the layered dielectric sheet constituent sections 940, which form the steps 942. The stress concentration may occur at the edged grooves (the sharp grooves) 912. The edged grooves 912 may possibly become an origin of the crack in the dielectric resin 911.

Furthermore, it is difficult to align the axial end portions 941 of the layered dielectric sheet constituent sections 940 in the axial direction. In view of the above disadvantage, as shown in FIG. 31, it is conceivable to make a projecting length of each axial end portion 941 of the dielectric sheet 94, which projects from the axial end surface 924 of the central core 923, longer than a required length to provide an excess region. After the winding of the dielectric sheet 94 around the central core 923, it is conceivable to mechanically cut the excess region by a cutting blade.

However, when the excess region of the dielectric sheet 94 is mechanically cut by the cutting blade, the axial end portions 941 of the layered dielectric sheet constituent sections 940 at the cutting end may possibly be spread radially outward and thereby separated from one another, as shown in FIG. 31. Furthermore, as shown in FIG. 32, corners 943 of the cut end parts of the axial end portions 941 may possibly form sharp edges. As a result, edged grooves 912, which correspond to the corners 943 having the sharp edges, are formed in the dielectric resin 911 filled in the coil case. Each of the edged grooves 912 may possibly serve as an origin of a crack in the dielectric resin 911.

Furthermore, as shown in FIG. 33, the above described disadvantage of the mechanically cutting the excess region of the dielectric sheet 94 with the cutting blade may also occur in a case of cutting the dielectric sheet 94, which is wound only once around the central core (see the corner 943 having the sharp edge). The above disadvantage of the mechanically cutting the dielectric sheet 94 with the cutting blade may also occur in a case of cutting the dielectric sheet 94 along the axial end surface 924 of the central core 923, as shown in FIG. 34.

Furthermore, as shown in FIGS. 35 and 36, in some previously proposed ignition coils, an axial end portion 951 of a sheet 95 is folded against an axial end surface 925 of a central core 923 to limit generation of a crack in dielectric resin filled in spaces in a coil case. At the time of folding the axial end portion 951 of the sheet 95, a punch 97 is used to press and weld the axial end portion 951 of the sheet 95.

However, as shown in FIG. 37, when the axial end portion 951 of the sheet 95 is pressed by the punch 97, buckling or radially outward partial deformation of the axial end portion 951 of the sheet 95 may possibly occur. This occurs due to a rigidity of the sheet 95, which limits smooth folding movement of the axial end portion 951 of the sheet 95 toward a center of the central core 923. When the buckling or deformation of the sheet 95 occurs, a crack may possibly be generated in the dielectric resin filled in the spaces in the coil case.

Particularly, when a thermoplastic resin film, such as polyethylene terephthalate (PET) film, is used to form the sheet 95, the above disadvantage may possibly occur due to a relatively high rigidity of such a film.

The present invention addresses one or more of the above disadvantages. According to one aspect of the present invention, there is provided an ignition coil, which includes a central core, primary and secondary coils, a case, a dielectric sheet and dielectric resin. The central core is produced from at least one magnetic steel plate. Primary and secondary coils are produced by concentrically winding primary and secondary electric wires, respectively, around the central core. The case receives the primary and secondary coils. The dielectric sheet is wound around an outer peripheral surface of the central core. At least one of axial end portions of the dielectric sheet includes an axially projecting portion, which projects from an axial end surface of the central core. An inner peripheral side axial end corner and an outer peripheral side axial end corner in the axially projecting portion are respectively formed into a blunt smooth round shape. The dielectric resin is filled in spaces in the case.

According to another aspect of the present invention, there is provided, an ignition coil, which includes a central core, primary and secondary coils, a case, a dielectric sheet and dielectric resin. The central core is produced from at least one magnetic steel plate. The primary and secondary coils are produced by concentrically winding primary and secondary electric wires, respectively, around the central core. The case receives the primary and secondary coils. The dielectric sheet is wound around an outer peripheral surface of the central core. An outer peripheral side axial end corner of at least one of axial end portions of the dielectric sheet is formed into a blunt smooth round shape. The dielectric resin is filled in spaces in the case.

According to another aspect of the present invention, there is provided an ignition coil, which includes primary and secondary coils, a case, a central core, a sheet and thermoset resin. The case receives the primary and secondary coils. The central core is made of a magnetic material and is positioned radially inward of the primary and secondary coils. The sheet relieves a thermal stress and is wound around the central core. At least one of axial end portions of the sheet forms a folded end portion, which is folded against a corresponding axial end surface of the central core or an axially outer end surface of a connecting member connected to the corresponding axial end surface of the central core. The folded end portion includes a plurality of generally arcuate segments, which are folded one after another on one circumferential side thereof. A first circumferential end and a second circumferential end of each generally arcuate segment are folded in such a manner that the first circumferential end of the generally arcuate segment is folded over a second circumferential end of an adjacent one of the plurality of generally arcuate segments located on a first circumferential end side of the generally arcuate segment, and the second circumferential end of the generally arcuate segment is folded beneath a first circumferential end of another adjacent one of the plurality of generally arcuate segments located on a second circumferential end side of the generally arcuate segment. The thermoset resin is filled in spaces in the case.

According to another aspect of the present invention, there is provided an ignition coil, which includes primary and secondary coils, a case, a central core, a sheet and thermoset resin. The case receives the primary and secondary coils. The central core is made of a magnetic material and is positioned radially inward of the primary and secondary coils. The sheet relieves a thermal stress and is wound around the central core. At least one of axial end portions of the sheet forms a folded end portion, which is folded against a corresponding axial end surface of the central core or an axially outer end surface of a connecting member connected to the corresponding axial end surface of the central core. The folded end portion includes a plurality of generally arcuate bottom side segments and a plurality of generally arcuate top side segments, which are alternately arranged in a circumferential direction. A first circumferential end and a second circumferential end of each generally arcuate top side segment are folded in such a manner that the first circumferential end of the generally arcuate top side segment is folded over an adjacent one of the plurality of generally arcuate bottom side segments located on a first circumferential end side of the generally arcuate top side segment, and the second circumferential end of the generally arcuate top side segment is folded over another adjacent one of the plurality of generally arcuate bottom side segments located on a second circumferential end side of the generally arcuate top side segment. The thermoset resin is filled in spaces in the case.

According to another aspect of the present invention, there is also provided a manufacturing method of an ignition coil, which includes a central core that is produced from at least one magnetic steel plate; primary and secondary coils that are produced by concentrically winding primary and secondary electric wires, respectively, around the central core; a case that receives the primary and secondary coils; a dielectric sheet that is wound around an outer peripheral surface of the central core; and dielectric resin that is filled in spaces in the case. According to the manufacturing method, the dielectric sheet is wound around the outer peripheral surface of the central core in such a manner that at least one of axial end portions of the dielectric sheet projects from a corresponding axial end surface of the central core to form an axially projecting portion. An excess region of the axially projecting portion is melted and is cut by one of a hot wire and a laser beam in such a manner that an inner peripheral side axial end corner and an outer peripheral side axial end corner in the axially projecting portion are respectively formed into a blunt smooth round shape.

According to another aspect of the present invention, there is provided a manufacturing method of an ignition coil, which includes a central core that is produced from at least one magnetic steel plate; primary and secondary coils that are produced by concentrically winding primary and secondary electric wires, respectively, around the central core; a case that receives the primary and secondary coils; a dielectric sheet that is wound around an outer peripheral surface of the central core; and dielectric resin that is filled in spaces in the case. The dielectric sheet is wound around the outer peripheral surface of the central core in such a manner that at least one of axial end portions of the dielectric sheet projects from a corresponding axial end surface of the central core to form an axially projecting portion. The axially projecting portion is heated in such a manner that an inner peripheral side axial end corner and an outer peripheral side axial end corner in the axially projecting portion are respectively formed into a blunt smooth round shape.

According to another aspect of the present invention, there is provided a manufacturing method of an ignition coil, which includes: primary and secondary coils; a case that receives the primary and secondary coils; a central core that is made of a magnetic material and is positioned radially inward of the primary and secondary coils; and thermoset resin filled in spaces in the case. According to the manufacturing method, a sheet, which relieves a thermal stress, is wound around the central core. At least one of axial end portions of the sheet is folded against a corresponding axial end surface of the central core or an axially outer end surface of a connecting member connected to the corresponding axial end surface of the central core, in such a manner that a plurality of points of the axial end portion, which are arranged one after another in a circumferential direction of the axial end portion, are partially folded first, so that a folded end portion, which includes a plurality of generally arcuate segments folded one after another in the circumferential direction, is formed.

According to another aspect of the present invention, there is provided a manufacturing apparatus for manufacturing an ignition coil, which includes: primary and secondary coils; a case that receives the primary and secondary coils; a central core that is made of a magnetic material and is positioned radially inward of the primary and secondary coils; and thermoset resin filled in spaces in the case. The manufacturing apparatus includes a folding jig that folds an axially projecting portion of a sheet, which relieves a thermal stress and is wound around the central core, against a corresponding axial end surface of the central core or an axially outer end surface of a connecting member connected to the corresponding axial end surface of the central core. An axial end of the folding jig includes a recessed processing portion that engages a plurality of points of the axially projecting portion, which are arranged one after another in a circumferential direction of the axially projecting portion, to form creases in the plurality of points, respectively.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

First Embodiment

Figure 1:
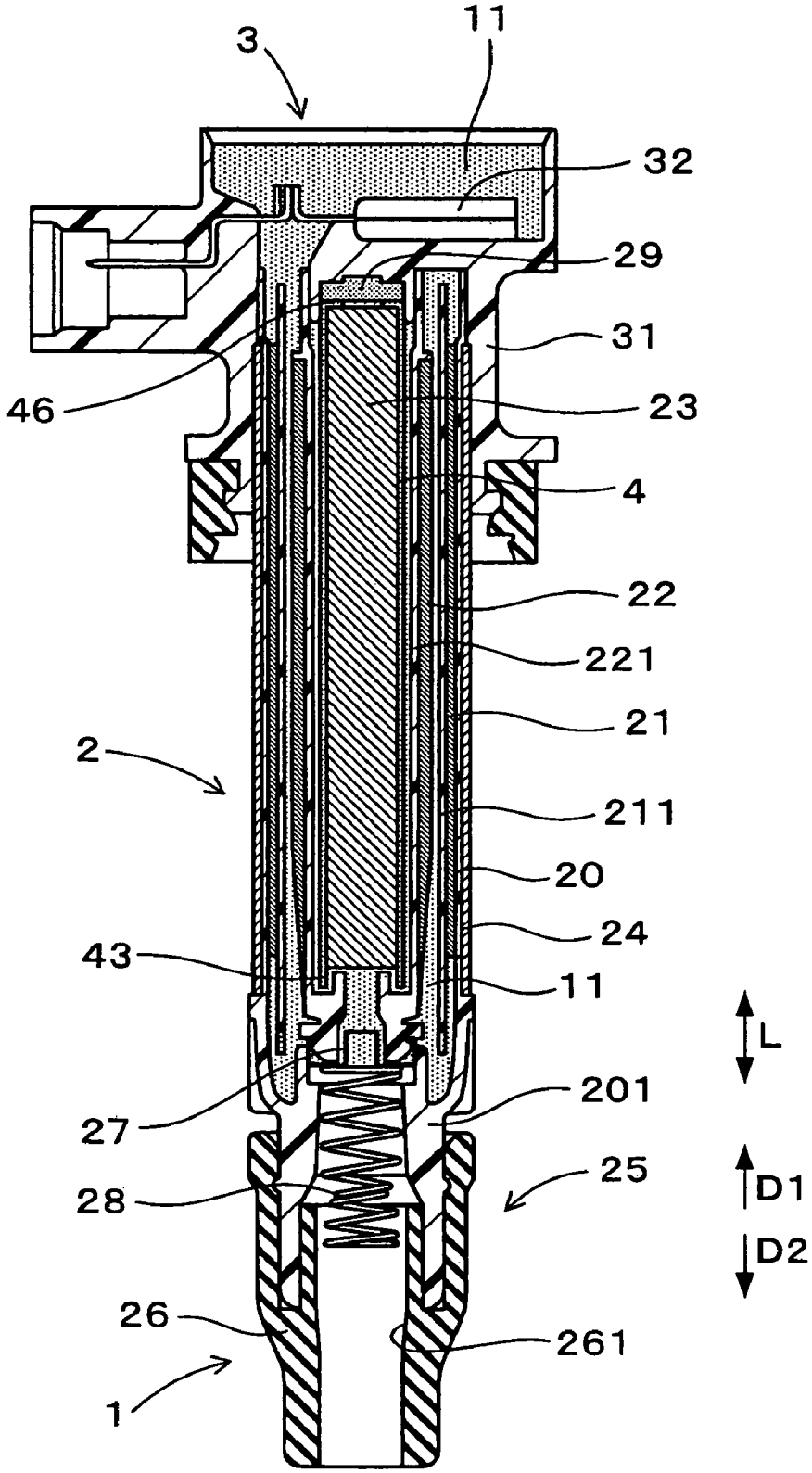
FIG. 1 is a cross sectional view of an ignition coil according to a first embodiment of the present invention.

As shown in FIG. 1, an ignition coil 1 of the present embodiment includes a central core 23, a primary coil 21, a secondary coil 22 and a coil case 20. The central core 23 is made of magnetic steel plates. The primary coil 21 and the secondary coil 22 are produced by concentrically winding a primary electric wire and a secondary electric wire around the central core 23. The coil case 20 receives the primary coil 21 and the secondary coil 22. In the ignition coil 1, a dielectric sheet 4, which reduces an applied stress, is wound around an outer peripheral surface of the central core 23, and dielectric resin 11 is filled in gaps inside the coil case 20.

Figure 3:
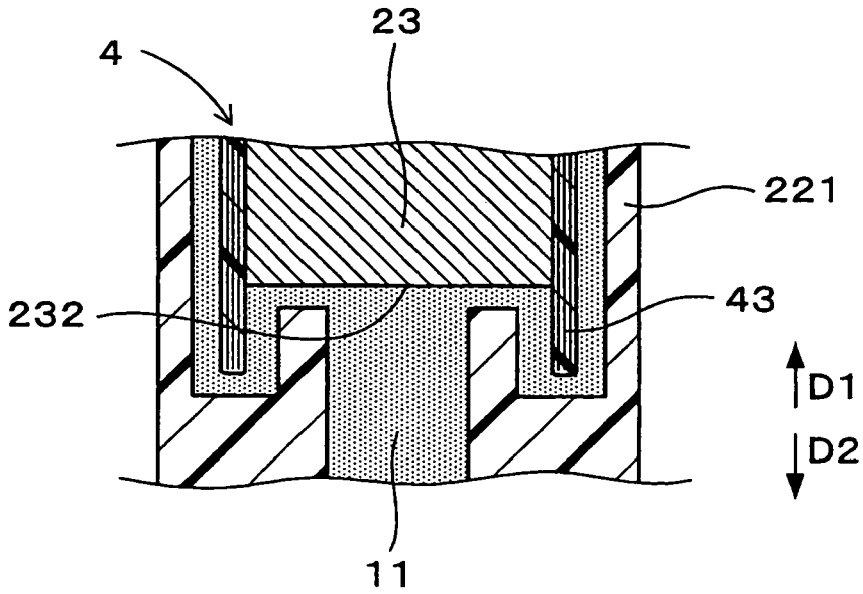
FIG. 3 is an enlarged cross sectional view showing the other axial end portion of the central core according to the first embodiment.
Figure 4:
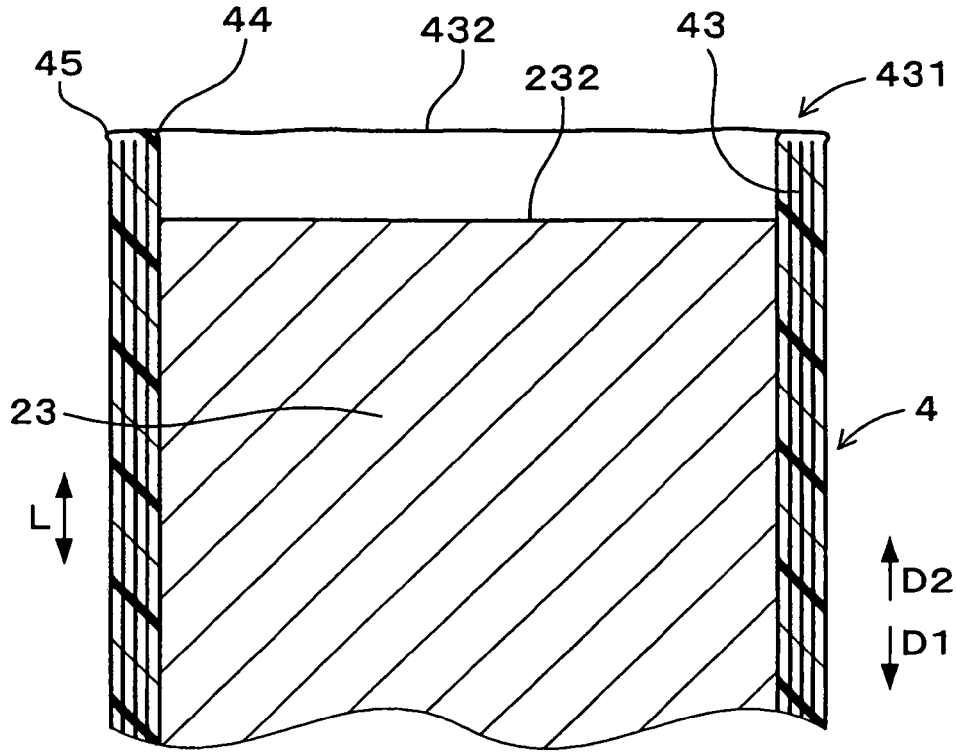
FIG. 4 is an enlarged cross sectional view showing an axially projecting portion of a dielectric sheet according to the first embodiment.
Figure 5:
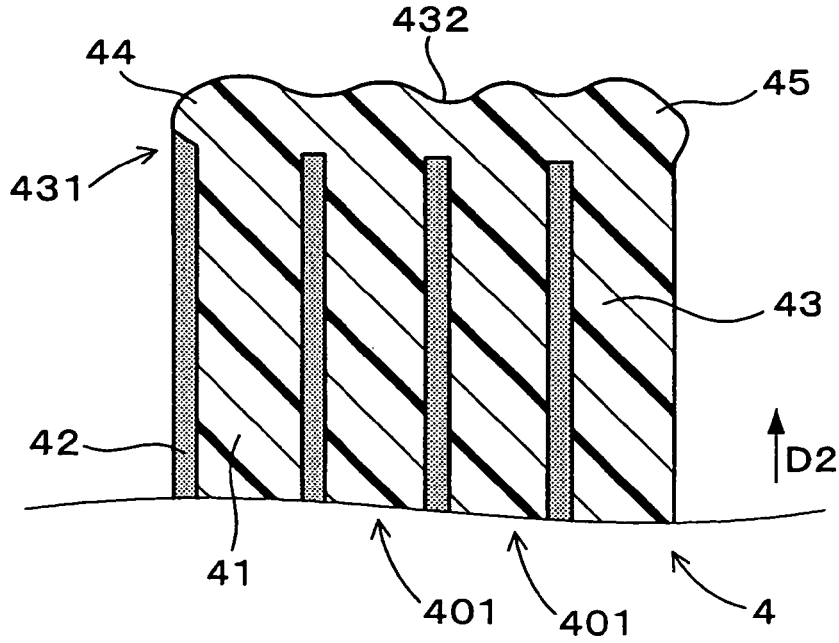
FIG. 5 is an enlarged cross sectional view showing an axial end part of the axially projecting portion of the dielectric sheet according to the first embodiment.

As shown in FIG. 3, at least one axial end portion of the dielectric sheet 4, which extends in an axial direction L, projects from a corresponding axial end surface 232 of the central core 23 to form an axially projecting portion 43. As shown in FIGS. 4 and 5, an inner peripheral side axial end corner 44 and an outer peripheral side axial end corner 45 of the axially projecting portion 43 are respectively formed into a blunt smooth round shape.

The ignition coil 1 and a manufacturing method thereof will be described with reference to FIGS. 1 to 14.

As shown in FIG. 1, the ignition coil 1 of the present embodiment is a stick type ignition coil. Specifically, a cylindrical portion 2 of the ignition coil 1, which includes the primary coil 21, the secondary coil 22, the central core 23 and the coil case 20, is fitted into a corresponding plughole of the engine.

The primary coil 21 is formed by winding the insulation-coated primary electric wire multiple times around an outer peripheral surface of a cylindrical primary spool 211 made of resin. The secondary coil 22 is formed by winding the insulation-coated secondary electric wire multiple times around a cylindrical secondary spool 221 made of resin. Here, the number of turns of the secondary electric wire is larger than that of the primary electric wire. The secondary coil 22 is placed radially inward of the primary coil 21, and the central core 23, which is made of the magnetic steel plates, is placed radially inward of the secondary coil 22. The primary coil 21 is received in the cylindrical coil case 20 made of resin. An outer peripheral core 24, which is made of magnetic steel plates and has a cylindrical cross section, is positioned radially outward of the coil case 20.

The magnetic steel plates, which constitute the central core 23, are planar silicon steel plates, each of which has a dielectric insulation coating. The planar silicon steel plates are stacked one after another in a diametric direction, which is perpendicular to the axial direction L of the ignition coil 1. The magnetic steel plates of the outer peripheral core 24 are cylindrical silicon steel plates, each of which has a slit (a gap) that extends in the axial direction L. These cylindrical steel plates are stacked one after another in a radial direction in such a manner that bonding agent is radially interposed between each adjacent two cylindrical steel plates to bond therebetween. A magnetic flux, which is generated upon supplying electric current to the primary coil 21, can be amplified by passing the magnetic flux through the central core 23 and the outer peripheral core 24.

Figure 2:
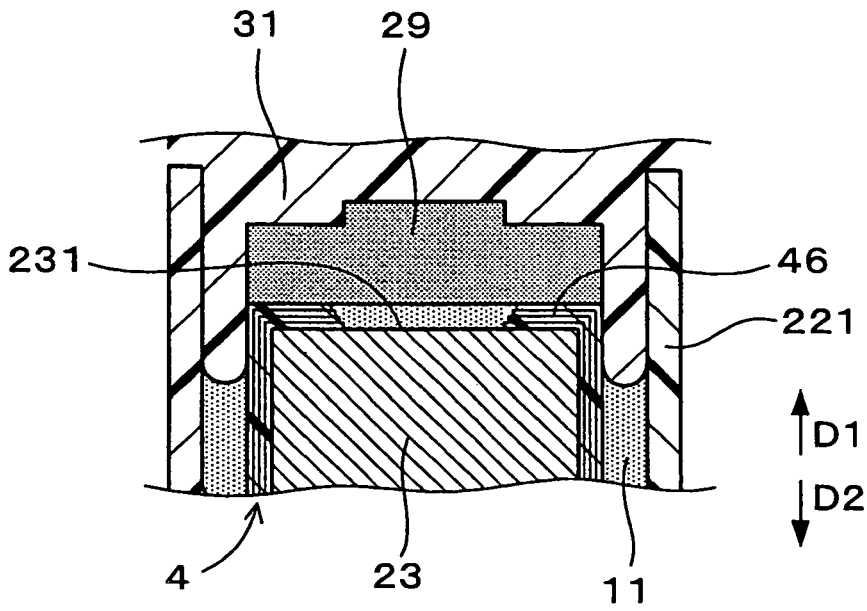
FIG. 2 is an enlarged cross sectional view showing one axial end portion of a central core according to the first embodiment.

FIG. 2 is an enlarged view around one end of the central core 23 at one axial side D1, and FIG. 3 is an enlarged view showing the other end of the central core 23 at the other axial side D2.

As shown in FIG. 2, one axial end portion of the dielectric sheet 4 at the one axial side D1 is folded radially inward along an end surface 231 of the central core 23 at the one axial side D1. A resilient body (a cushioning member) 29 is positioned at the end surface 231 of the central core 23 at the one axial side D1 to clamp a portion of the dielectric sheet 4 in corporation with the end surface 231 of the central core 23.

As shown in FIG. 3, the other axial end portion of the dielectric sheet 4 at the other axial side D2 protrudes in the axial direction L from the end surface 232 of the central core 23 and thereby forms the axially projecting portion 43. The axially projecting portion 43 of the dielectric sheet 4 is received in the other axial end portion of the secondary spool 221 at the other axial side D2.

As shown in FIG. 5, the dielectric sheet 4 includes a sheet base 41, which is made of synthetic resin, and a bonding layer 42 made of bonding agent is coated over a back surface of the sheet base 41. In the present instance, the sheet base 41 is a polyethylene terephthalate (PET) film, and the bonding layer 42 is made of an acrylic bonding agent. A thickness of the dielectric sheet 4 (a sum of a thickness of the sheet base 41 and a thickness of the bonding layer 42) is in a range of 0.025 to 0.1 mm.

As shown in FIG. 1, the dielectric resin 11 is filled in a space between the dielectric sheet 4 placed over the outer peripheral surface of the central core 23 and the secondary coil 22, a space between the secondary coil 22 and the primary coil 21 and a space between the primary coil 21 and the coil case 20. In the present instance, the dielectric resin 11 is epoxy resin.

As shown in FIG. 1, in the ignition coil 1, an igniter arrangement 3, which supplies electric power to the primary coil 21, is provided at the one axial side D1 of the coil case 20, and a plug connector arrangement 25, to which a spark plug is connected, is provided at the other axial side D2 of the coil case 20.

The igniter arrangement 3 includes an igniter 32, which supplies the electric power to the primary coil 21 and is received in an igniter case 31. After installation of the igniter 32 in the igniter case 31, the dielectric resin 11 is filled in the igniter case 31. The dielectric resin 11 is continuously filled in the respective spaces in the coil case 20 and the respective spaces in the igniter case 31.

The igniter 32 includes an electric power control circuit and an ionic current sensing circuit. The electric power control circuit includes a switching element, which is operated by a signal supplied from an engine control unit (ECU). The ionic current sensing circuit senses ionic current.

In the ignition coil 1, when pulsed spark generation signals are outputted from the ECU to the igniter 32, the electric power control circuit of the igniter 32 is operated, so that electric current flows instantaneously through the primary coil 21, and thereby a magnetic field, which passes through the central core 23 and the outer peripheral core 24, is generated. Then, an induction magnetic filed, which passes the central core 23 and the outer peripheral core 24 in a direction opposite from the above magnetic field, is generated. Due to the generation of the induction magnetic field, an induced electromotive force (a back electromotive force) is generated in the secondary coil 22, and thereby a spark is generated from the spark plug connected to the ignition coil 1.

Furthermore, as shown in FIG. 1, the plug connector arrangement 25 includes a plug cap 26 made of rubber. The plug cap 26 is provided to an extended portion 201, which extends from the coil case 20. A plug installation opening 261, into which the spark plug is installed, is formed in the plug cap 26. Furthermore, a coil spring 28 is arranged in the plug installation opening 261 to engage with the spark plug. The coil spring 28 is electrically connected to a high voltage side end of the secondary coil 22 through a high voltage terminal 27.

FIG. 4 is a diagram showing the axially projecting portion 43 of the dielectric sheet 4, and FIG. 5 is a diagram showing the axial end part 431 of the axially projecting portion 43 in an enlarged scale.

In the present instance, as indicated in FIG. 4, the dielectric sheet 4 is wound multiple times around the outer peripheral surface of the central core 23, so that multiple dielectric sheet constituent sections 401 are formed as layers. Each adjacent two dielectric sheet constituent sections 401 are bonded together by the corresponding bonding layer 42 provided to the back surface of the sheet base 41.

Furthermore, as shown in FIG. 5, at the axial end part 431 of the axially projection portion 43, the adjacent wound parts of the adjacent sheet base 41 are thermally welded to each other. The bonding layer 42 at the axial end part 431 of the axially projecting portion 43 at each dielectric sheet constituent section 401 is melted and is dissolved into the sheet base 41 when the wound parts of the sheet base 41 are thermally fused together, i.e., thermally welded together.

Furthermore, as shown in FIG. 5, the inner peripheral side axial end corner 44, which has the blunt smooth round shape, is formed as an inner peripheral side axial end corner 44 of the radially innermost dielectric sheet constituent section 401. In addition, the outer peripheral side axial end corner 45, which has the blunt smooth round shape, is formed as an outer peripheral side axial end corner 45 of the radially outermost dielectric sheet constituent section 401.

Although not illustrated, a permanent magnet, which increases a magnetic flux density, may be provided to each of the opposed end surfaces of the central core 23, which are opposed to each other in the axial direction L. In such a case, at least one of the end portions of the dielectric sheet 4, which is wound around the outer peripheral surface of the central core 23, may have the axially projection portion 43, which projects in the axial direction L from an end surface of the corresponding permanent magnet.

Next, the manufacturing method and advantages of the ignition coil 1 will be described.

In the manufacturing method of the present embodiment, the dielectric sheet 4 is wound around the central core 23 through a sheet winding step and a melting and cutting step described below.

Specifically, in the present embodiment, the dielectric sheet 4 is wound around the central core 23 in the sheet winding step. The dielectric sheet 4 is wound multiple times around the outer peripheral surface of the central core 23 in such a manner that the bonding layer 42, which is provided to the back surface of the dielectric sheet 4, is bonded to the radially adjacent part of the sheet base 41. At this time, the dielectric sheet 4 is wound around the central core 23 in a state where the axial end portion of the dielectric sheet 4 projects from the end surface 232 of the central core 23 at the other axial end side D2.

Figure 6:
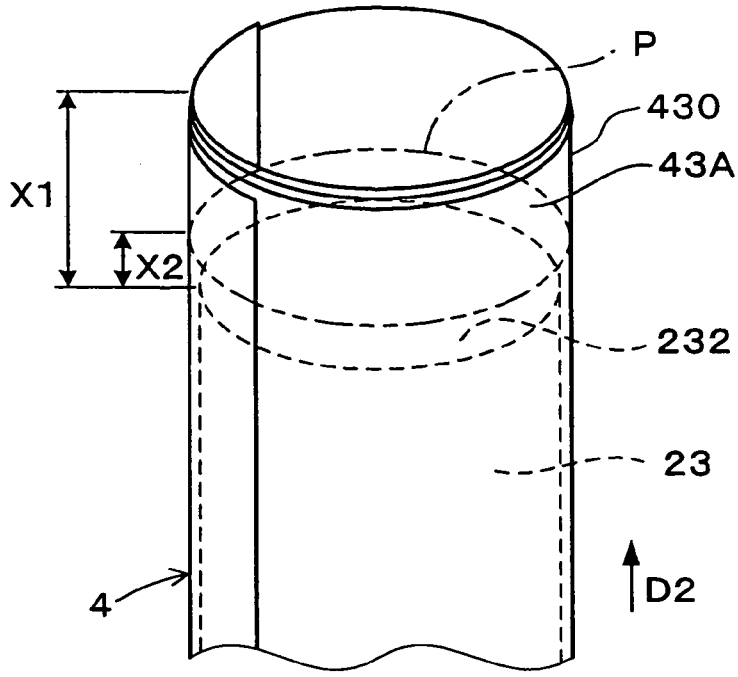
FIG. 6 is a perspective view showing the axially projecting portion of the dielectric sheet before melting and cutting according to the first embodiment.

Then, as shown in FIG. 6, an axial end portion of each dielectric sheet constituent section 401 wound around the central core 23 at the other axial side D2 projects in the axial direction L from the end surface 232 of the central core 23 at the other axial side D2 to form an axially projecting portion 43A. Furthermore, an end portion of each layered dielectric sheet constituent section 401 at the one axial side D1 projects in the axial direction L from the end surface 231 of the central core 23 at the one axial side D1 to form a foldable projecting portion 46.

Figure 7:
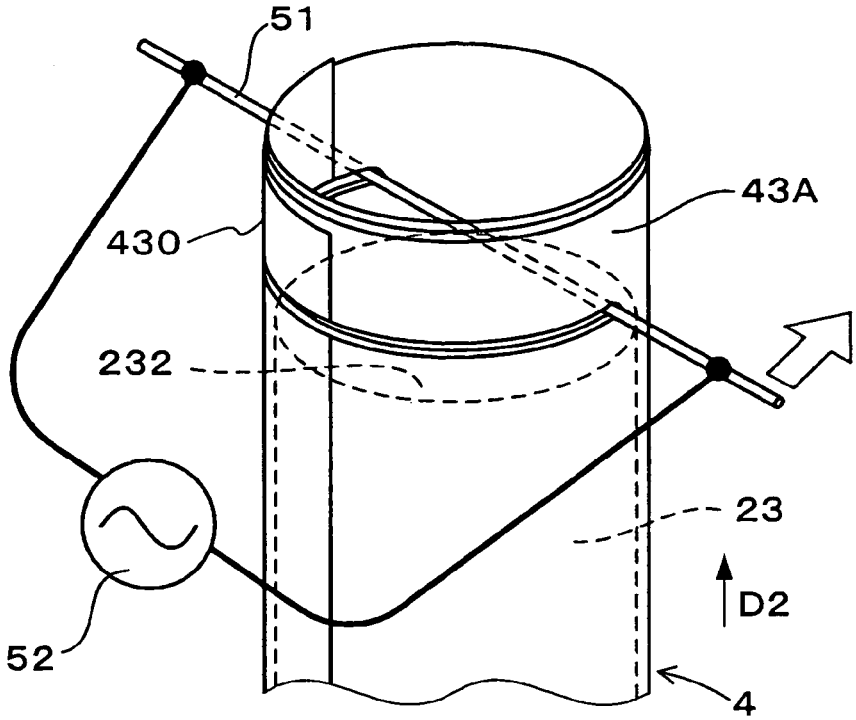
FIG. 7 is a perspective view showing a state where an excess region of the axially projecting portion is melted and cut by a hot wire according to the first embodiment.

A projecting length X1 of the axially projecting portion 43A is made longer than a required length X2, so that the axially projecting portion 43A has an excess region 430, which is melted and is cut in the following melting and cutting step. In FIG. 6, the axial end part 431 of the axially projecting portion 43, which has the required length X2, is indicated by a dot-dot-dash line R Next, as shown in FIG. 7, a hot wire (a hot wire cutter) 51 is used to melt and cut the excess region 430 of the axially projecting portion 43A in the melting and cutting step. The hot wire 51 is made of, for example, a Nichrome wire and is connected to a power source device 52. When the hot wire 51 is energized by the power source device 52, a Joule heat is generated from the hot wire 51. The hot wire 51 is relatively moved in a direction perpendicular to the axial direction L of the central core 23, so that the hot wire 51 melts and cuts the excess region 430 of the axially projecting portion 43A of the dielectric sheet 4 wound around the central core 23.

Even when the bonding agent 42 of the dielectric sheet 4 adheres to the hot wire 51, the adhered bonding agent 42 can be removed by appropriately controlling the temperature of the hot wire 51.

Figure 8:
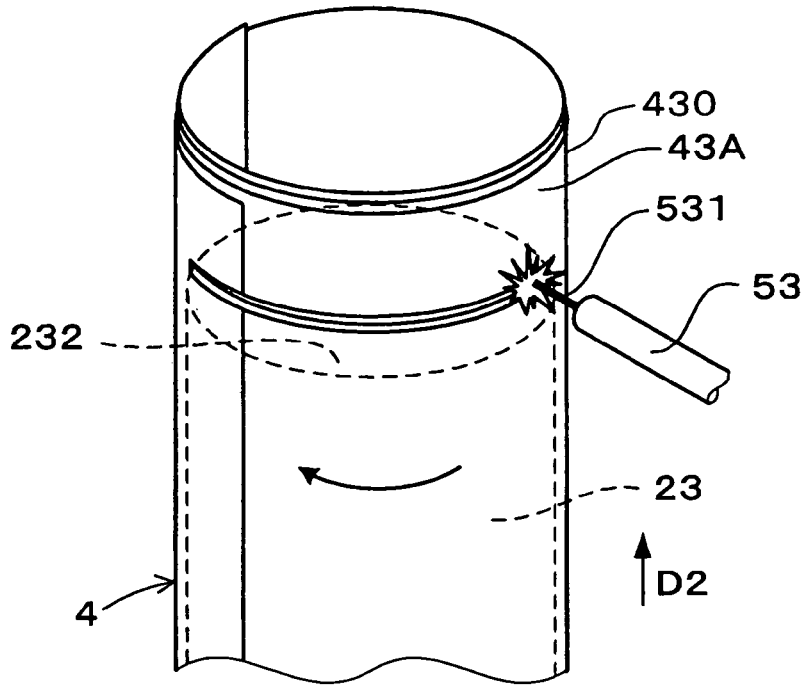
FIG. 8 is a perspective view showing a state where the excess region of the axially projecting portion is melted and cut by a laser beam according to the first embodiment.
Figure 9:
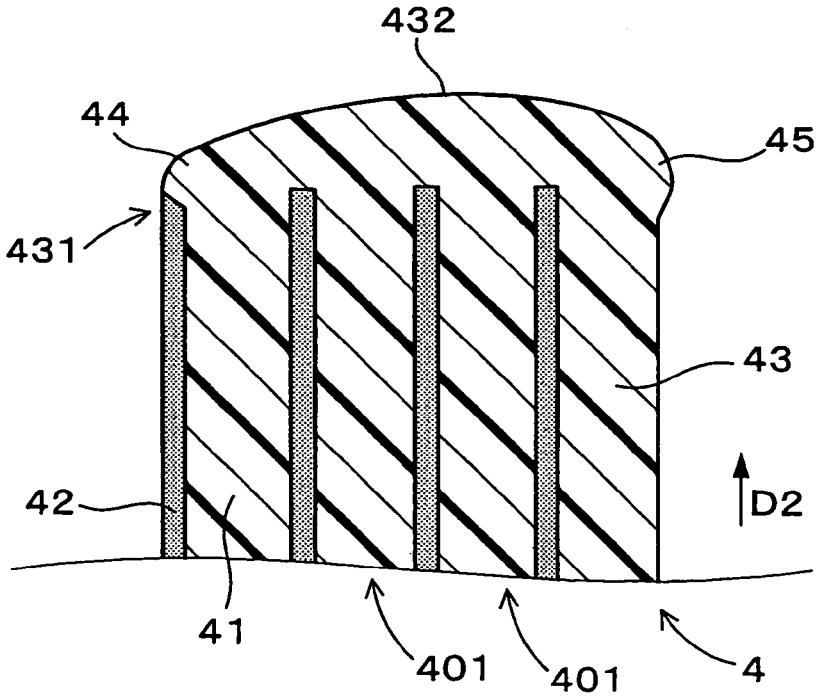
FIG. 9 is an enlarged cross sectional view showing another example of the axial end part of the axially projecting portion according to the first embodiment.
Figure 10:
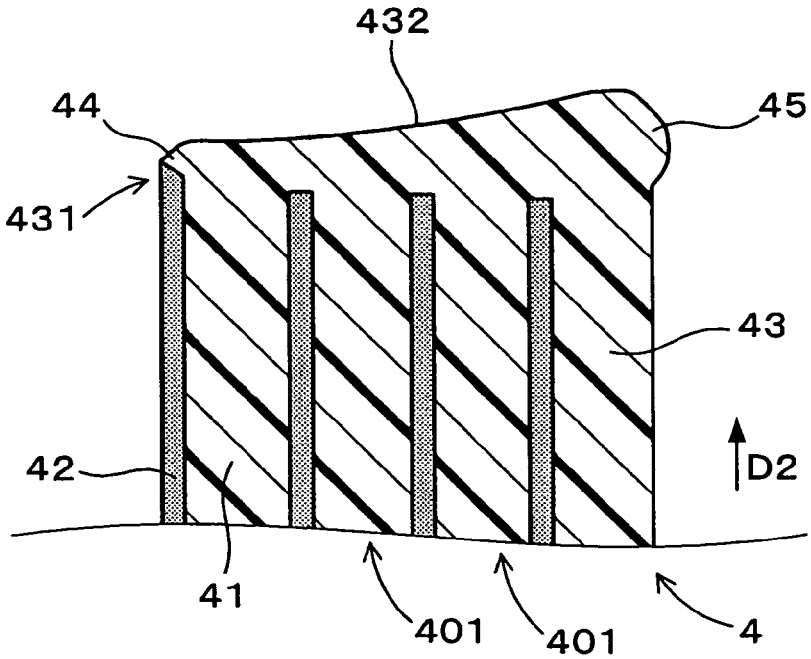
FIG. 10 is an enlarged cross sectional view showing another example of the axial end part of the axially projecting portion according to the first embodiment.

As shown in FIG. 8, in place of the hot wire 51, a laser beam 531 may be used to melt and cut the excess region 430 of the axially projecting portion 43A of the dielectric sheet 4. In such a case, the laser beam 531 is outputted from a laser gun 53 in the direction perpendicular to the axial direction of the central core 23. At that time, the central core 23, around which the dielectric sheet 4 is wound, is rotated relative to the laser beam 531, so that the laser beam 531 melts and cuts the excess region 430 of the axially projecting portion 43A of the dielectric sheet 4.

As shown in FIGS. 4 and 5, at the time of melting and cutting, a subject cutting segment of the axially projecting portion 43 to be cut is melted by the hot wire 51. Then, the adjacent layered wound parts of the sheet base 41 at the subject cutting segment are thermally fused together. In this way, the axial end part 431 of the axially projecting portion 43 is strongly joined together, and the inner peripheral side axial end corner 44 and the outer peripheral side axial end corner 45 in the axial end part 431 of the axially projecting portion 43 are respectively formed into the blunt smooth round shape.

Thereby, the winding of the dielectric sheet 4 relative to the central core 23 is finished.

The axial end surface 432 of the axially projecting portion 43 may be formed into a wavy form like one shown in FIG. 5. Alternatively, the axial end surface 432 of the axially projecting portion 43 may be formed into a convex shape like one shown in FIG. 9. Further alternatively, the axial end surface 432 of the axially projecting portion 43 may be formed into a concave shape like one shown in FIG. 10.

Thereafter, the ignition coil 1 is assembled by placing the primary coil 21, the secondary coil 22 and the central core 23 with the wound dielectric sheet 4 into the coil case 20.

At the time of this assembly, the axially projecting portion 43 of the dielectric sheet 4, which is wound around the central core 23, is placed in the end portion of the secondary spool 221 at the other axial side D2, and the foldable projecting portion 46 of the dielectric sheet 4 is folded radially inward against the end surface 231 of the central core 23 at the one axial side D1. Then, the resilient body 29, which is received in the igniter case 31, is placed against the foldable projecting portion 46, which is folded against the end surface 231 of the central core 23 at the one axial side D1.

Then, after the assembling of the ignition coil 1, the dielectric resin 11, which has been heated and melted, is filled in the respective spaces in the igniter case 31 and the respective spaces in the coil case 20.

Thereafter, when the filled dielectric resin 11 is solidified, edged grooves (sharp grooves), which cause stress concentration, will not be formed in the dielectric resin 11, which is filled in the coil case 20 and is located adjacent to the rounded inner peripheral side axial end corner 44 and the rounded outer peripheral side axial end corner 45. Instead of the edged grooves (the sharp grooves), rounded smooth grooves are formed in the dielectric resin 11.

In the ignition coil 1 of the present embodiment, the inner peripheral side axial end corner 44 and the outer peripheral side axial end corner 45 of the axially projecting portion 43 are respectively formed into the blunt smooth round shape. In this way, at the time of repeating the heating and cooling cycle, it is possible to limit formation of a crack in the dielectric resin 11.

Specifically, at the time of repeating the combustion process and the exhaust process of the internal combustion engine, to which the above ignition coil 1 is installed, when the heating and cooling is repeated in the ignition coil 1, a thermal stress is generated in the constituent components of the ignition coil 1. A coefficient of linear expansion of the central core 23 and a coefficient of linear expansion of the dielectric resin 11 differ from each other, and the dielectric resin 11 experiences a larger thermal deformation in comparison to the central core 23. At the time of the thermal deformation, when the dielectric resin 11 contracts due to the cooling of the ignition coil 1, a contraction force of the dielectric resin 11 can be reduced by the dielectric sheet 4, which is wound around the outer peripheral surface of the central core 23.

The rounded smooth grooves are formed in the dielectric resin 11, which is filled in the coil case 20 and is positioned adjacent to the inner peripheral side axial end corner 44 and the outer peripheral side axial end corner 45 at the axially projecting portion 43 of the dielectric sheet 4. Therefore, at the time of contraction of the dielectric resin 11 due to the cooling of the ignition coil 1, the stress concentration in the dielectric resin 11 can effectively limited, and thereby it is possible to limit the generation of a crack in the dielectric resin 11.

Figure 11:
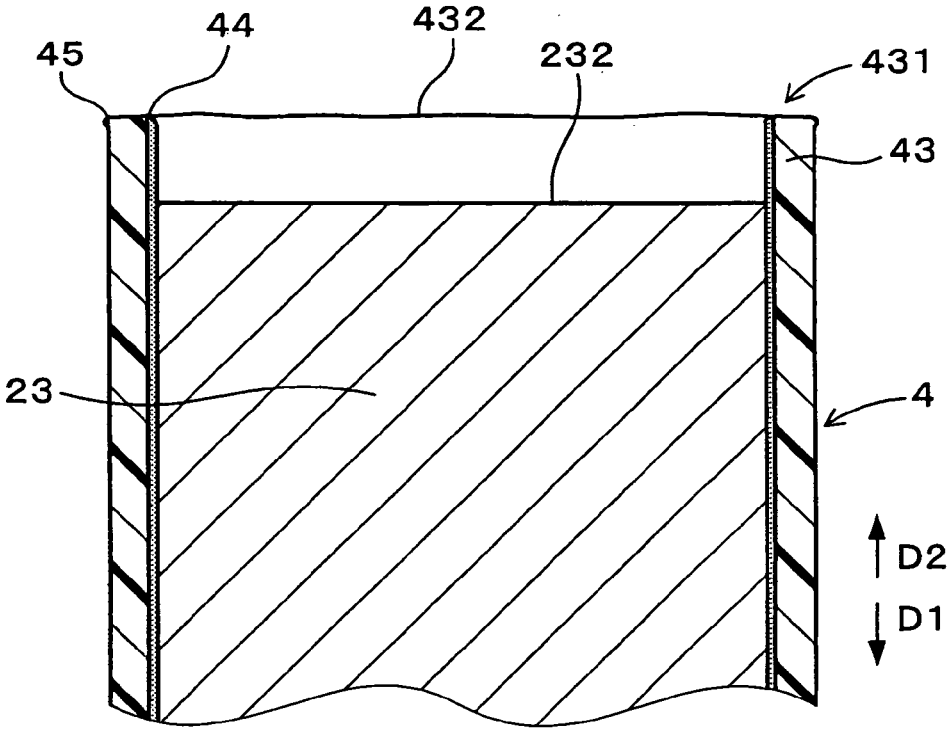
FIG. 11 is a cross sectional view showing an axially projecting portion of a dielectric sheet, which is wound only once around an outer peripheral surface of a central core according to the first embodiment.

In the above case, the dielectric sheet 4 is wound multiple times around the outer peripheral surface of the central core 23 to form the multilayered dielectric sheet constituent sections 401 of the dielectric sheet 4. Alternatively, as shown in FIG. 11, the dielectric sheet 4 may be wound only once around the outer peripheral surface of the central core 23 to form a single layer of the dielectric sheet 4.

Figure 12:
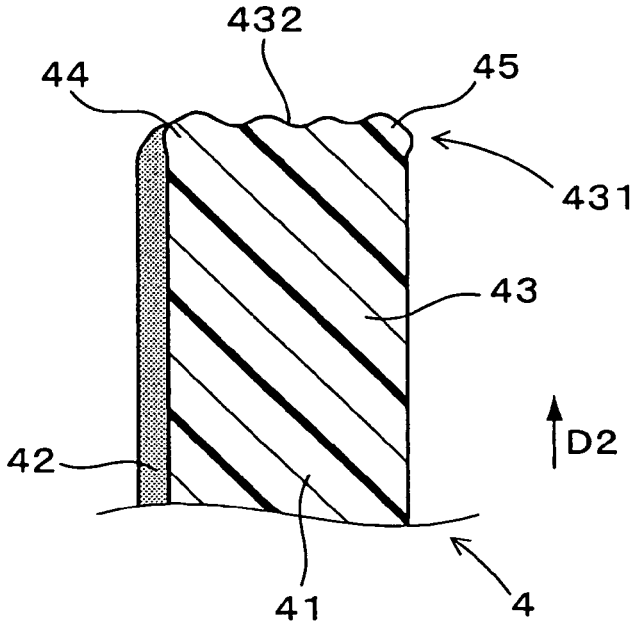
FIG. 12 is an enlarged cross sectional view showing an axial end part of an axially projecting portion of the dielectric sheet, which is wound only once around the central core according to the first embodiment.
Figure 13:
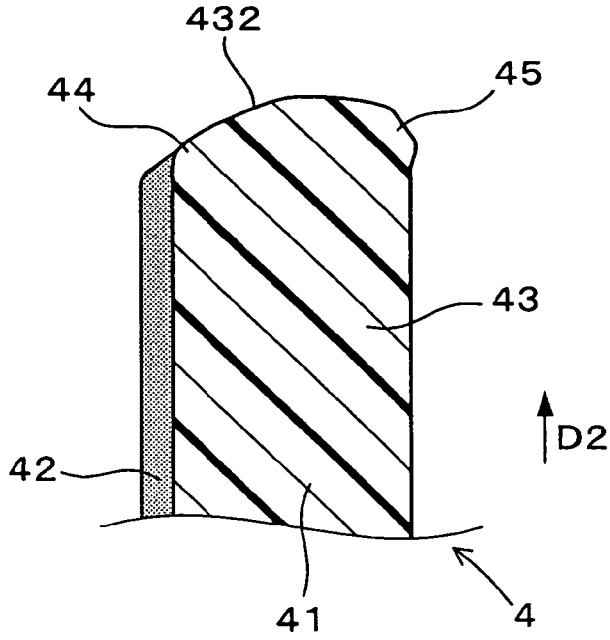
FIG. 13 is an enlarged cross sectional view showing another example of the axial end part of the axially projecting portion of the dielectric sheet, which is wound only once around the central core according to the first embodiment.
Figure 14:
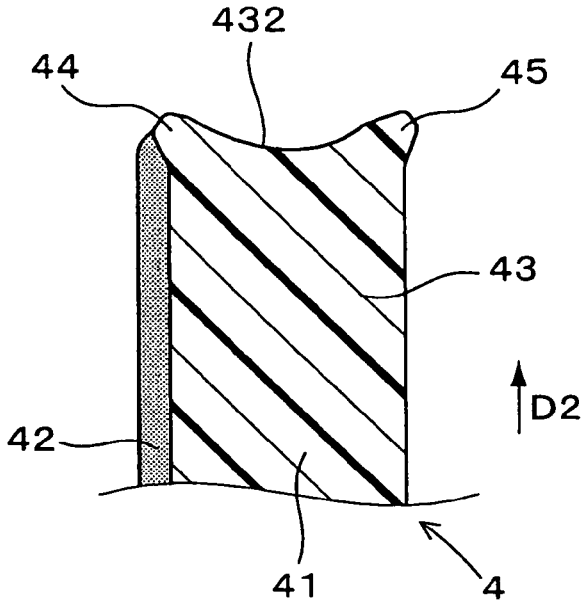
FIG. 14 is an enlarged cross sectional view showing another example of the axial end part of the axially projecting portion of the dielectric sheet, which is wound only once around the central core according to the first embodiment.

Even in such a case, the axial end surface 432 of the axially projecting portion 43 of the dielectric sheet 4 may be formed into a wavy form like one shown in FIG. 12. Alternatively, the axial end surface 432 of the axially projecting portion 43 may be formed into a convex shape like one shown in FIG. 13. Further alternatively, the axial end surface 432 of the axially projecting portion 43 may be formed into a concave shape like one shown in FIG. 14.

Second Embodiment

A second embodiment of the present invention will be described with reference to FIGS. 15 and 16. In the second embodiment, in place of the melting and cutting step of the first embodiment, a heating step described below is performed at the time of winding the dielectric sheet 4 around the outer peripheral surface of the central core 23.

Figure 15:
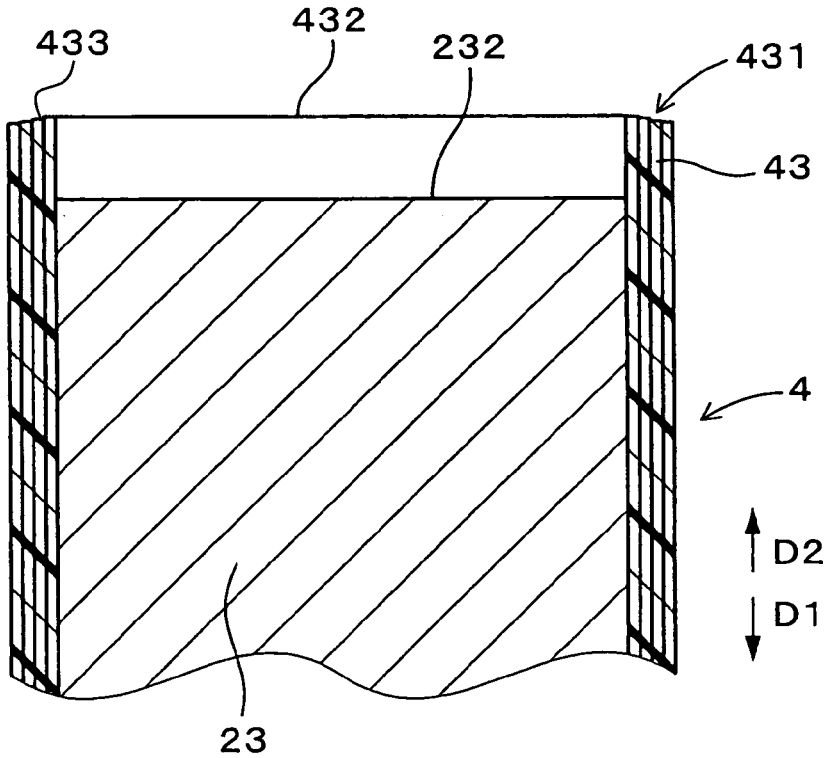
FIG. 15 is an enlarged cross sectional view showing an axially projecting portion of a dielectric sheet before heating and melting according to a second embodiment.

Specifically, as shown in FIG. 15, in the sheet winding step of the present embodiment, the dielectric sheet 4 is wound around the outer peripheral surface of the central core 23 without providing the excess region 430 in the axially projecting portion 43 of the dielectric sheet 4. In the present embodiment, the dielectric sheet 4 is also wound multiple times around the central core 23. At the time of winding the dielectric sheet 4, in the axially projecting portion 43, which projects from the end surface 232 of the central core 23 at the other axial side D2, axial end parts 431 of the dielectric sheet constituent sections 401 at the axially projecting portion 43 are slightly displaced from one another in the axial direction L. Thus, steps 433 are formed at the axial end parts 431 of the dielectric sheet constituent sections 401 in the axially projecting portion 43.

Figure 16:
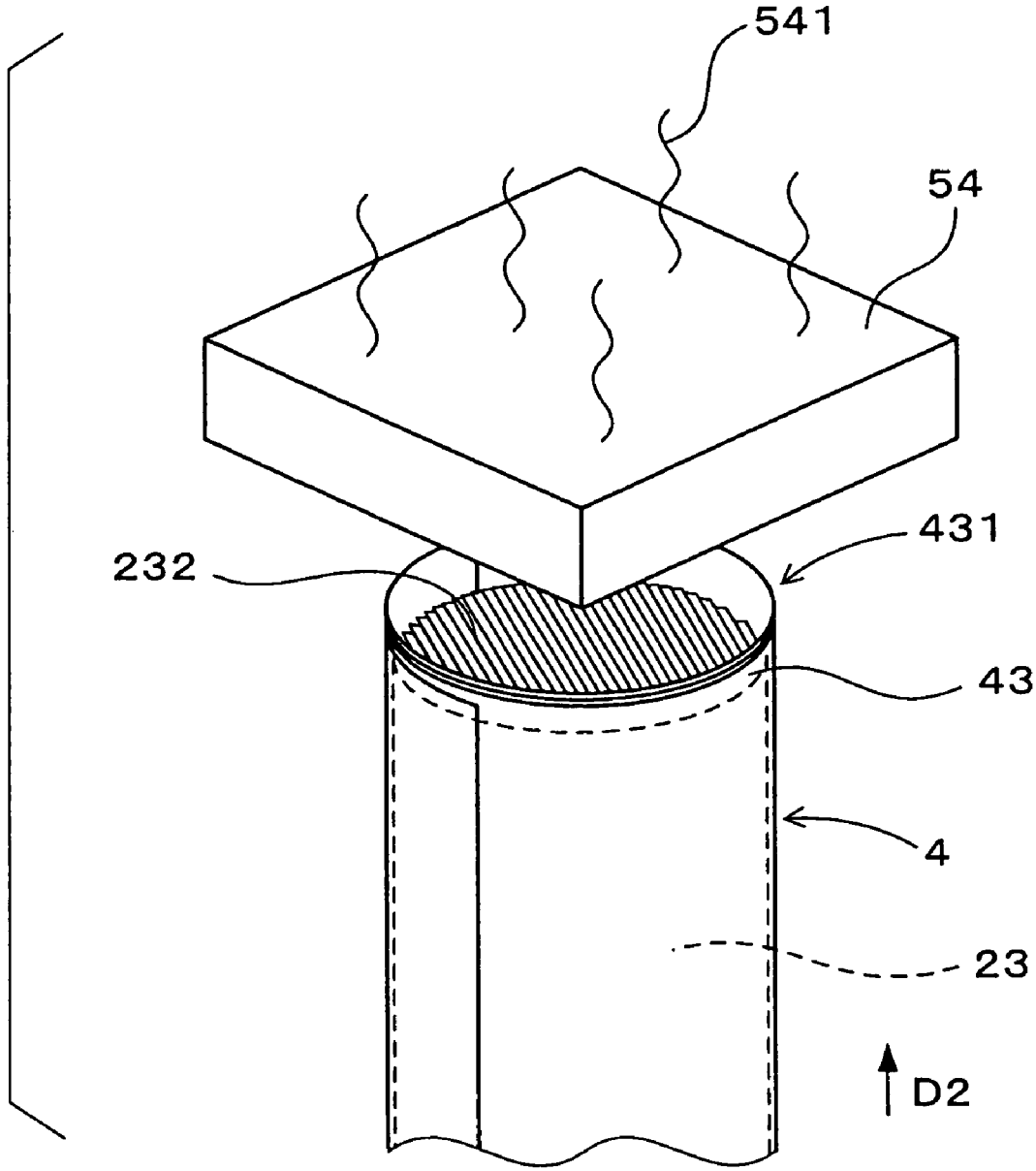
FIG. 16 is a perspective view showing a state where an axial end part of an axially projecting portion is heated by a hot plate according to the second embodiment.

Next, as shown in FIG. 16, in the heating step, the axially projecting portion 43 is heated. In the present embodiment, a hot plate 54, which is hated to the high temperature (the temperature that is sufficient to melt the dielectric sheet 4), is opposed to the axially projecting portion 43 of the dielectric sheet 4, which is wound around the central core 23. At this time, the axial end parts 431 of the layered dielectric sheet constituent sections 401 are fused together by the radiant heat 541 of the hot plate 54, and thereby the wound parts of the sheet base 41 in the axial end parts 431 of the layered dielectric sheet constituent sections 401 are thermally fused together.

In this way, the steps 433, which are initially present at the axial end parts 431 of the axially projecting portion 43, are substantially smoothened, and thereby the inner peripheral side axial end corner 44 and the outer peripheral side axial end corner 45 are respectively formed into the blunt smooth round shape.

Figure 17:
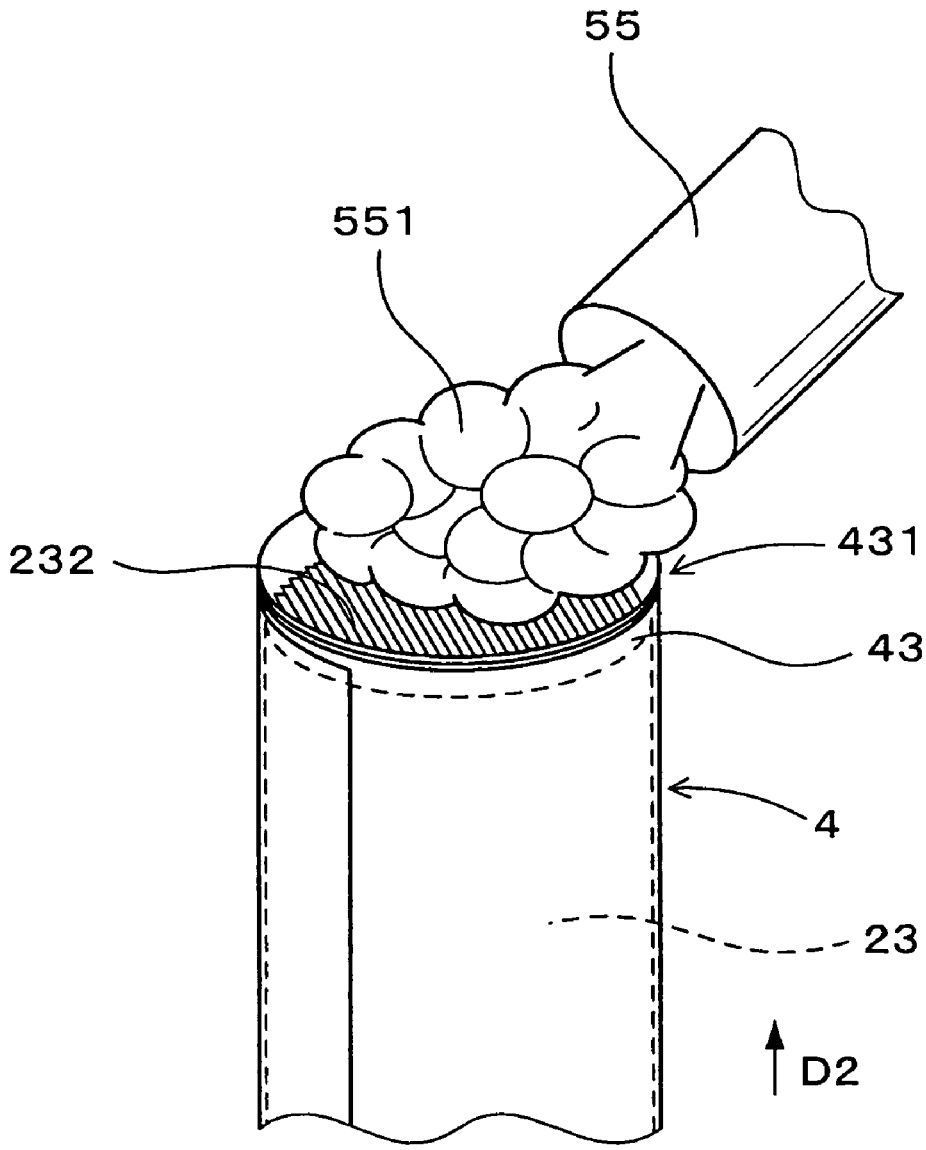
FIG. 17 is a perspective view showing a state where the axial end part of the axially projecting portion is heated by hot air according to the second embodiment.

In place of the hot plate 54, as shown in FIG. 17, hot air 551 may be blown to melt and thermally fuse the axial end parts 431 of the layered dielectric sheet constituent sections 401 of the axially projecting portion 43 of the dielectric sheet 4 together. In this case, the hot air 551 is discharged from a hot air nozzle 55 toward the axially projecting portion 43 of the dielectric sheet 4, which is wound around the central core 23, so that the axial end parts 431 of the layered dielectric sheet constituent sections 401 in the axially projecting portion 43 are melted and fused together.

In the present embodiment, the structure and the manufacturing method of the ignition coil 1 are similar to those of the first embodiment and can achieve the advantages similar to those of the first embodiment.

In the above embodiments, the sheet base 41 is made of the PET. Alternatively, the sheet base 41 may be made of a polyester resin. Furthermore, in the above embodiments, the dielectric resin 11 is the epoxy resin. Alternatively, the dielectric resin 11 may be thermoset resin, such as phenolic resin.

Third Embodiment

In the following description of a third embodiment, components similar to those of the first embodiment will be indicated by the same numerals and will not be described further in detail.

Figure 18:
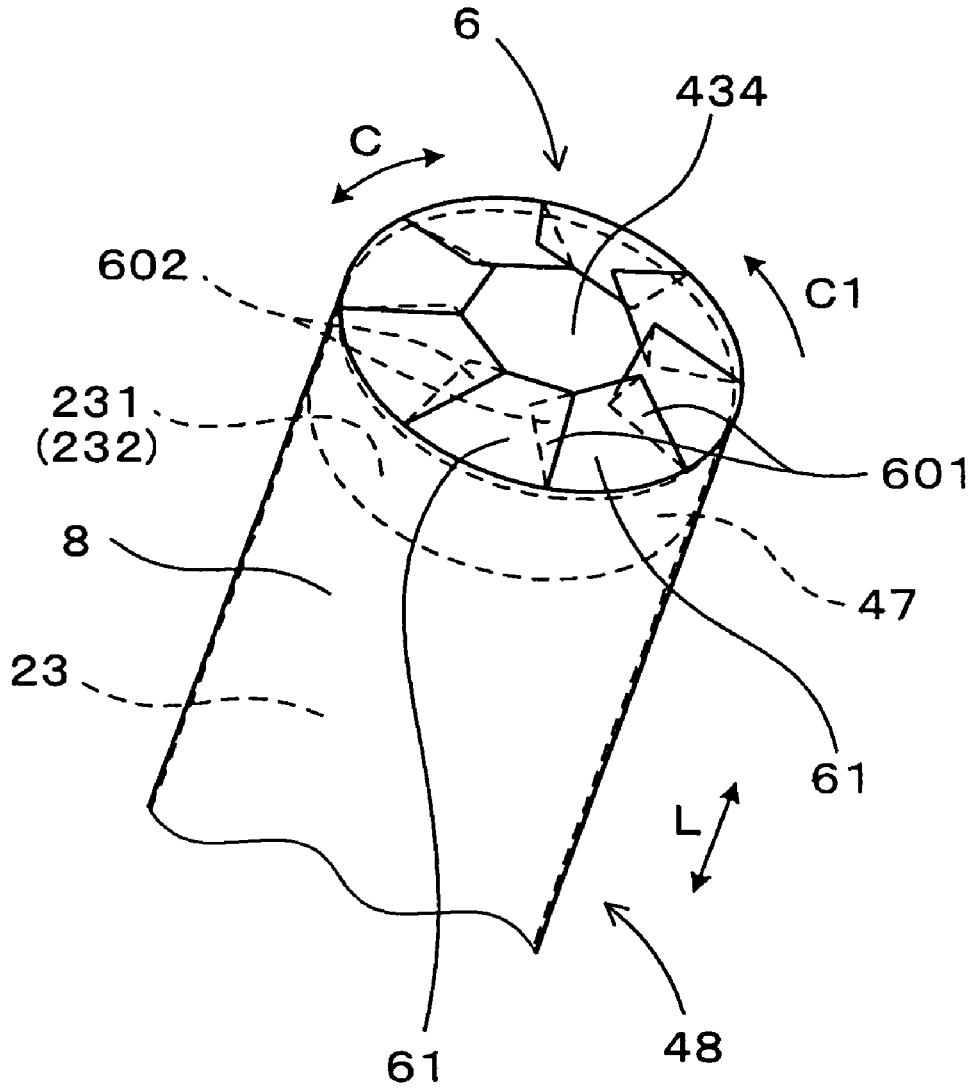
FIG. 18 is a perspective view of a central core assembly that includes a central core, around which a sheet for relieving a thermal stress is wound according to a third embodiment of the present invention.
Figure 19:
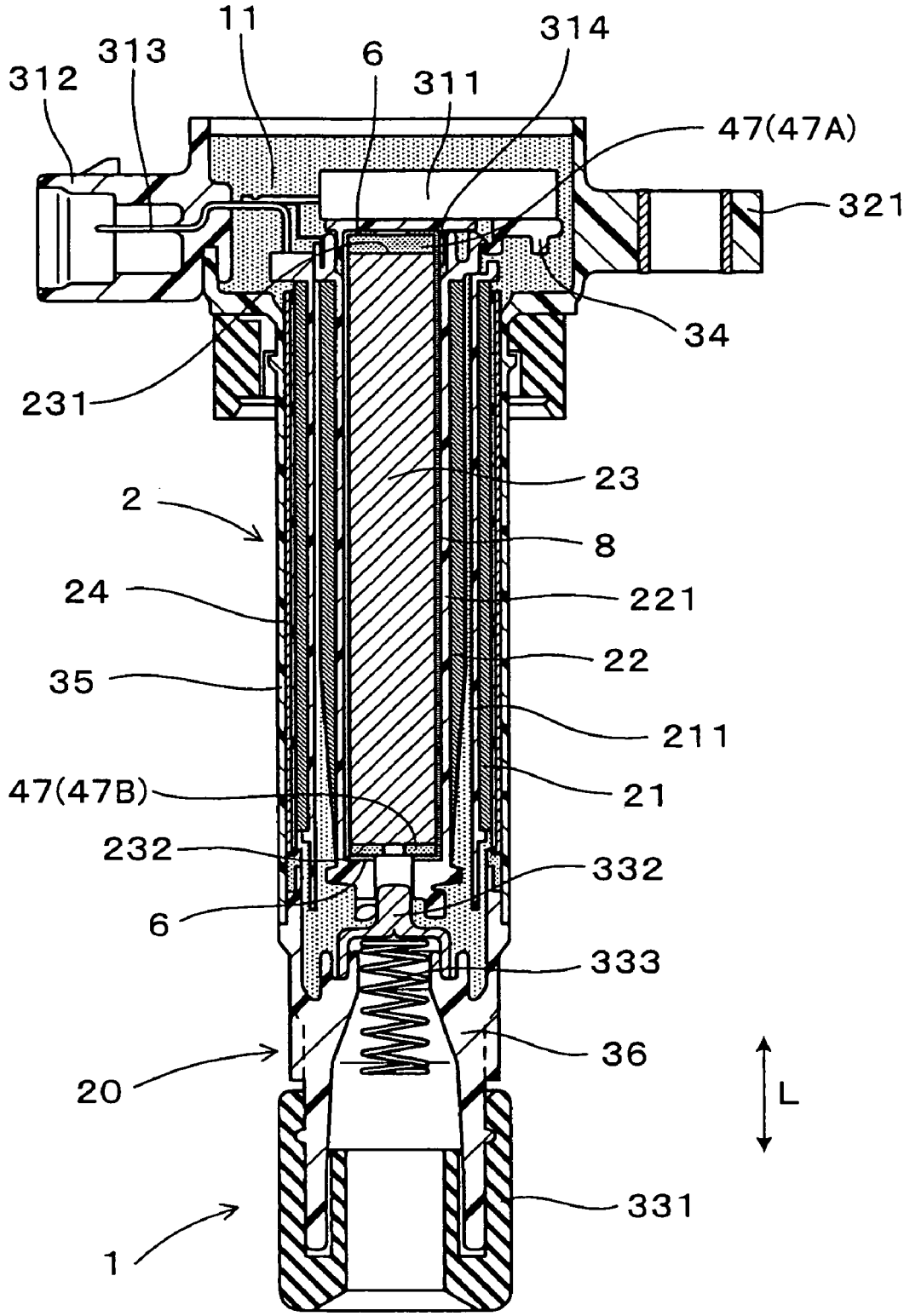
FIG. 19 is a cross sectional view of an ignition coil according to the third embodiment.

As shown in FIGS. 18, 19, in the ignition coil 1 according to the third embodiment, the primary coil 21 and the secondary coil 22 are received in the case 20. Furthermore, the central core 23, which is made of the magnetic body (magnetic steel plates), is positioned radially inward of the primary coil 21 and the secondary coil 22. The dielectric resin (thermoset resin) 11 is filled in the spaces in the case 20. A resilient body (a cushioning member) 47, which serves as a connecting member, is connected to each of the axial end surfaces 231, 232 of the central core 23. A dielectric sheet (the dielectric tape) 8, which relieves thermal stress, is wound around the central core 23 and the two resilient bodies 47. Axial end portions of the sheet 8, which are axially opposed to each other in the axial direction L, form folded end portions 6, respectively. Each folded end portion 6 is folded against an axially outer end surface 434 of the corresponding resilient body 47.

As sown in FIG. 18, the folded end portion 6 of the present embodiment has a plurality of generally arcuate segments 61, which are folded one after another on one circumferential side C1 thereof in a circumferential direction C of the folded end portion 6. One circumferential end (first circumferential end) 601 of each arcuate segment 61 is folded over the other circumferential end (second circumferential end) 602 of the next adjacent arcuate segment 61, and the other circumferential end 602 of each arcuate segment 61 is folded beneath the one circumferential end 601 the precedent adjacent arcuate segment 61.

Each folded end portion 6 of the sheet 8 is heated by ultrasonic wave or heat, so that the arcuate segments 61 are thermally fused together, i.e., thermally welded together.

The structure of the ignition coil 1, a manufacturing method of the ignition coil 1 and a manufacturing apparatus 7 of the ignition coil 1 will be described with reference to FIGS. 18 to 27.

The structures of the primary coil 21, of the secondary coil 22, of the central core 23, and of the outer peripheral core 24 are substantially the same as those of the first embodiment and thereby will not be described further.

As shown in FIG. 19, an igniter 311 is provided to one axial end of the ignition coil 1 to supply electric power to the primary coil 21. Furthermore, a plug cap 331 is provided to the other axial end of the ignition coil 1 to receive a spark plug.

The case 20 includes a plug base portion 36, a coil case portion 35 and an igniter base portion 34. The plug cap 331, a secondary terminal (a high voltage terminal) 332 and a spring 333 are arranged in the plug base portion 36. The primary coil 21, the secondary coil 22, the central core 23 and the outer peripheral core 24 are arranged in the coil case portion 35. The igniter 311 is arranged in the igniter base portion 34.

Although not depicted, the spark plug is received in the plug cap 331 in such a manner that a terminal portion of the spark plug engages the spring 333. Furthermore, in the igniter base portion 34, conductive pins 313 of the igniter 311 are insert molded to form a connector 312. Furthermore, in the coil case portion 35, a flange 321, which is used to install the ignition coil 1 to the engine, is formed.

The dielectric resin 11 is filled continuously in the case 20, which is surrounded by the plug base portion 36, the coil case portion 35 and the igniter base portion 34.

The igniter 311 includes an electric power control circuit and an ionic current sensing circuit. The electric power control circuit includes a switching element, which is operated by a signal supplied from an engine control unit (ECU). The ionic current sensing circuit senses ionic current.

Figure 22:
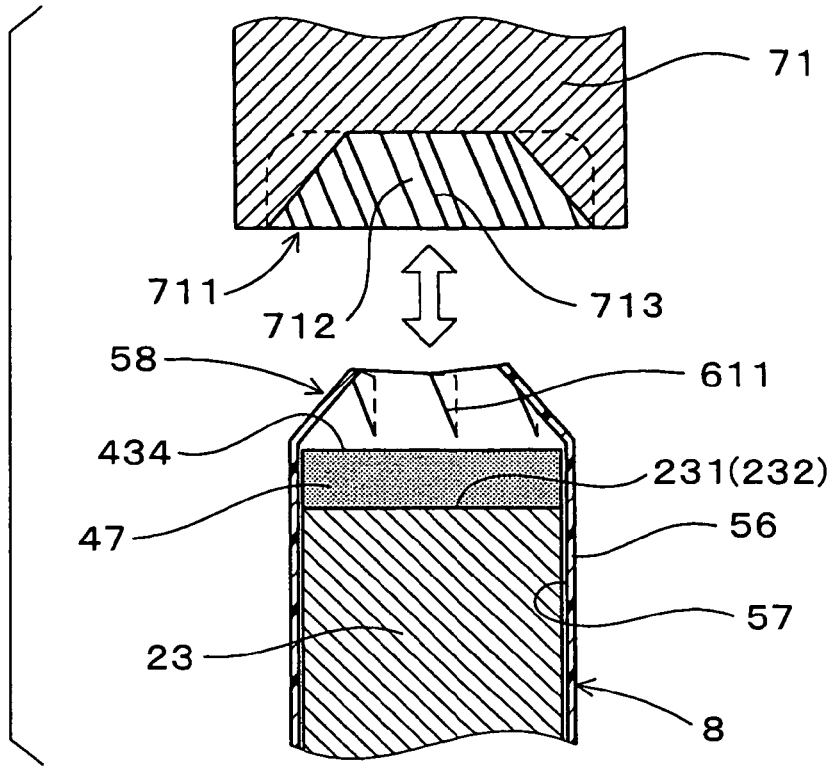
FIG. 22 is a cross sectional view showing a state where creases are provided in an axially projecting portion of the sheet in a folding step according to the third embodiment.

As shown in FIG. 22, the sheet 8 includes a sheet base (a tape base) 56, which is made of synthetic resin, and a bonding layer 57, which is made of bonding agent, is applied to a back surface of the sheet base 56. In the present instance, the sheet base 56 is the polyethylene terephthalate (PET) film, and the bonding layer 57 is made of an acrylic bonding agent. A thickness of the sheet 8 (a sum of a thickness of the sheet base 56 and a thickness of the bonding layer 57) is in a range of 0.025 to 0.1 mm. Furthermore, in the present embodiment, the sheet 8 is wound multiple times over the outer peripheral surface of the central core 23. The number of turns (layers) of the sheet 8 may be for example, 2 to 5 times (layers).

As shown in FIG. 19, the dielectric resin 11 is filled in the case 20. More specifically, the dielectric resin 11 is filled in the space between the sheet 8 around the central core 23 and the secondary spool 221, the respective space between turns of the secondary electric wire of the secondary coil 22, the space between the secondary coil 22 and the primary spool 211, the respective space between turns of the primary electric wires of the primary coil 21, the space between the primary coil 21 and the outer peripheral core 24 and the space between the outer peripheral core 24 and the case 20. In the present instance, the dielectric resin 11 is epoxy resin.

With reference to FIG. 19, as described above, in the ignition coil 1, the resilient bodies 47, which serve as connecting members, are provided to the axial end surfaces 231, 232, respectively, of the central core 23. In the present instance, the resilient body 47, which is arranged at the one axial end surface 231 of the central core 23, is sponge 47A, and the resilient body 47, which is arranged at the other axial end surface 232 of the central core 23 is rubber 47B.

One axial end portion of the sheet 8 is folded against an axially outer end surface 434 of the sponge 47A, which is arranged at the one axial end surface 231 of the central core 23. The other axial end portion of the sheet 8 is folded against an axially outer end surface 434 of the rubber 47B, which is arranged at the other axial end surface 232 of the central core 23.

Furthermore, the central core 23 and the rubber 47B are received in the secondary spool 221, and the sponge 47A is received in an aligning part 314, which is formed in the igniter base portion 34.

In the ignition coil 1, when pulsed spark generation signals are outputted from the ECU to the igniter 311, the electric power control circuit of the igniter 311 is operated, so that electric current flows through the primary coil 21, and thereby a magnetic field, which passes through the central core 23 and the outer peripheral core 24, is generated. Then, when the electric current flowing in the primary coil 21 is stopped, an induction magnetic filed, which passes the central core 23 and the outer peripheral core 24 in a direction opposite from the above magnetic field, is generated. Due to the generation of the induction magnetic field, an induced electromotive force (a back electromotive force) is generated in the secondary coil 22, and thereby a spark is generated from the spark plug connected to the ignition coil 1.

A manufacturing apparatus 7 and a manufacturing method for manufacturing the ignition coil 1 will be described.

The manufacturing apparatus 7 for manufacturing the ignition coil 1 is used to assemble a central core assembly 48, in which the sheet 8 is wound around the central core 23.

Figure 20:
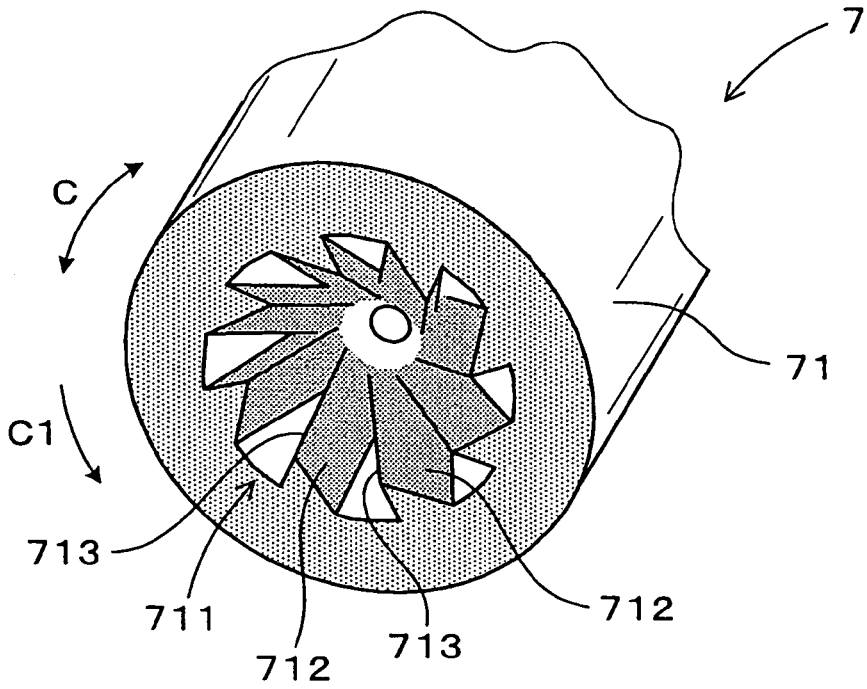
FIG. 20 is a perspective view showing a folding jig according to the third embodiment.

As shown in FIG. 20, the manufacturing apparatus 7 includes a folding jig 71, which is used to fold an axially projecting portion (a projecting end portion) 58 of the sheet 8, which projects from the central core 23 and the corresponding resilient body 47 in the axial direction L, against the end surface 434 of the corresponding resilient body 47 provided to the corresponding end surface 231, 232 of the central core 23. The folding jig 71 includes a recessed processing portion 711, which engages a plurality of points of the axially projecting portion 58 of the sheet 8, which are arranged one after another in the circumferential direction C, so that creases 611 are formed at these points (see FIG. 22)

As shown in FIG. 20, the recessed processing portion 711 includes a plurality of tilted wedge projections 712 that project from multiple points, respectively, of the recessed processing portion 711, which are arranged one after another in the circumferential direction C. Each tilted wedge projection 712 has a tilted configuration for radially inwardly urging the axially projecting portion 58 of the sheet 8. Furthermore, each tilted wedge projection 712 extends radially outward from the center of the recessed processing portion 711 and is tilted on the one circumferential side C1. Furthermore, each tilted wedge projection 712 has a crease forming blade (a crease forming edge) 713 at an apex of the tilted wedge projection 712. The crease forming blade 713 is used to form the corresponding crease 611 in the axially projecting portion 58 of the sheet 8.

Furthermore, the manufacturing apparatus 7 includes a holding jig (not shown) and a drive source (not shown). The holding jig holds the central core 23, around which the sheet 8 is wound. The drive source drives the folding jig 71 to move toward the holding jig.

In the manufacturing method of the ignition coil 1, a winding step, a folding step and a welding step described below are performed to produce the central core assembly 48.

Figure 21:
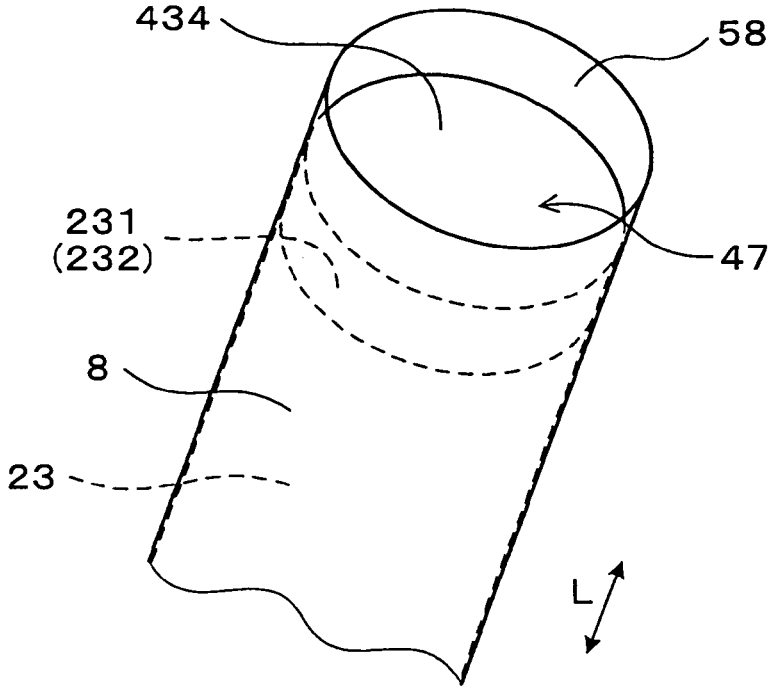
FIG. 21 is a perspective view showing a state where the sheet is wound around the central core according to the third embodiment.

At the time of producing the central core assembly 48, first, as shown in FIG. 21, the sheet 8, which relives the thermal stress, is wound around the central core 23 in the winding step. At this time, each of the axial end portions of the sheet 8 is projected from the axially outer end surface 434 of the corresponding resilient body 47 connected to the corresponding end surface 231, 232 of the central core 23, so that the pair of axially projecting portions 58 are formed.

Next, in the folding step, each axially projecting portion 58 is bent against the axially outer end surface 434 of the corresponding resilient body 47 connected to the corresponding end surface 231, 232 of the central core 23, so that the pair of folded end portions 6 are formed.

As shown in FIG. 22, in the folding step, the central core 23, around which the sheet 8 is wound, is held by the holding jig 71, and the recessed processing portion 711 of the folding jig 71 is opposed to the corresponding axially projecting portion 58 of the sheet 8, which projects from the axially outer end surface 434 of the corresponding resilient body 47 connected to the corresponding axial end surface 231, 232 of the central core 23. Then, the folding jig 71 is moved toward the axially projecting portion 58 of the sheet 8.

At this time, the crease forming blades 713 formed at the tilted wedge projections 712, respectively, of the recessed processing portion 711 are engaged with the multiple points of the axially projecting portion 58 of the sheet 8, which are arranged one after another in the circumferential direction C. In this way, the creases 611 are formed at the multiple points of the axially projecting portion 58 of the sheet 8, which are arranged one after another in the circumferential direction C and are engaged with the crease forming blades 713, respectively, so that these multiple points of the axially projecting portion 58, at which the creases 611 are formed, are partially folded first.

The creases 611 are formed toward the one circumferential side C1 in the axially projecting portion 58 of the sheet 8 due to the fact that the tilted wedge projections 712 are tilted on the one circumferential side C1. In this way, the folding jig 71 folds the axially projecting portion 58 of the sheet 8 to a predetermined tilt angle relative to the axial direction L of the central core 23.

Figure 23:
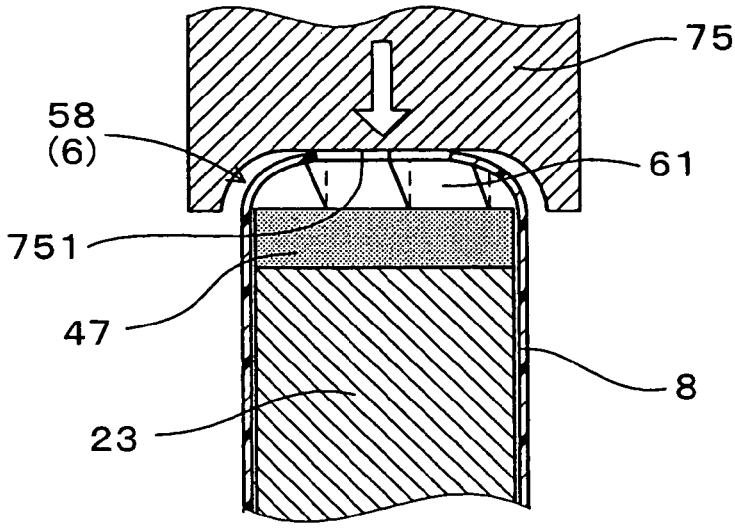
FIG. 23 is a cross sectional view showing a state where a folded end portion is formed in the sheet in a welding step according to the third embodiment.

Then, as shown in FIG. 23, in the welding step, a welding jig 75, which has a planar press surface 751, is used to fold the axially projecting portion 58 of the sheet 8, which has been previously folded to the predetermined angle, against the axially outer end surface 434 of the corresponding resilient body 47 connected to the corresponding axial end surface 231, 232 of the central core 23.

Specifically, the planar press surface 751 of the welding jig 75 is opposed to the axially projecting portion 58 of the sheet 8, which has been previously folded to the predetermined angle. Then, the welding jig 75, which is heated to the welding temperature, is moved toward the axially projecting portion 58 of the sheet 8.

At this time, the planar press surface 751 of the welding jig 75 engages the entire axially projecting portion 58 of the sheet 8. In this way, the multiple arcuate segments 61, which are folded one after another on the one circumferential side C1 in the circumferential direction C, are formed to correspond with the multiple creases 611 in the axially projecting portion 58 of the sheet 8. Furthermore, in the thus produced folded end portion 6, the multiple arcuate segments 61 are thermally welded together at the overlapped points between the multiple arcuate segments 61.

The above folding step and welding step are performed on the corresponding resilient body 47 connected to the corresponding axial end surface 231, 232 of the central core 23.

In this way, as shown in FIG. 18, in the present embodiment, there is produced the folded end portion 6, in which the one circumferential end 601 of each arcuate segment 61 is folded over the other circumferential end 602 of the next adjacent arcuate segment 61, and the other circumferential end 602 of each arcuate segment 61 is folded beneath the one circumferential end 601 of the precedent adjacent arcuate segment 61.

In this folded end portion 6, the multiple arcuate segments 61 are regularly folded to correspond with the multiple creases 611. Therefore, it is possible to limit occurrence of bucking or radially outward partial deformation in the folded end portion 6.

Thereafter, in the following assembling step, the primary coil 21, the secondary coil 22 and the central core 23 are installed in the case 20. Then, the dielectric resin 11 is filled in the case 20. At this time, it is possible to limit occurrence of the filling failure of the dielectric resin 11 or formation of the edge grooves (the sharp grooves), which cause the stress concentration, in the dielectric resin 11.

Therefore, through use of the manufacturing apparatus 7 and the manufacturing method for manufacturing the ignition coil 1 of the present embodiment, it is easy to produce the ignition coil 1, which can effectively limit generation of the crack in the dielectric resin 11.

Fourth Embodiment

In a fourth embodiment, various other types of folded end portion 6 of the sheet 8 will be described.

Figure 24:
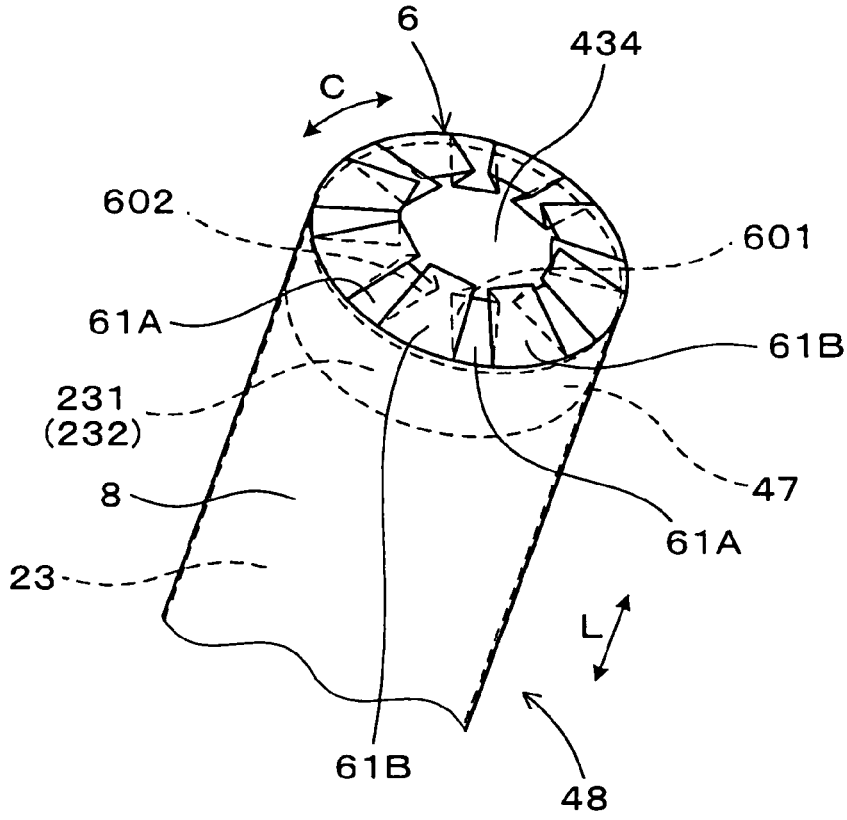
FIG. 24 is a perspective view of a central core assembly that includes a central core, around which a sheet for relieving a thermal stress is wound according to a fourth embodiment of the present invention.

As shown in FIG. 24, in the folded end portion 6 of the present embodiment, generally arcuate bottom side segments 61A and generally arcuate top side segments 61B are alternately arranged in the circumferential direction. Each top side segment 61B is folded over its adjacent bottom side segments 61A. One circumferential end (a first circumferential end) 601 of each top side segment 61B is folded over the next adjacent bottom side segment 61A, and the other circumferential end (a second circumferential end) 602 of each arcuate segment 61 is folded over the precedent adjacent bottom side segment 61A.

Figure 25:
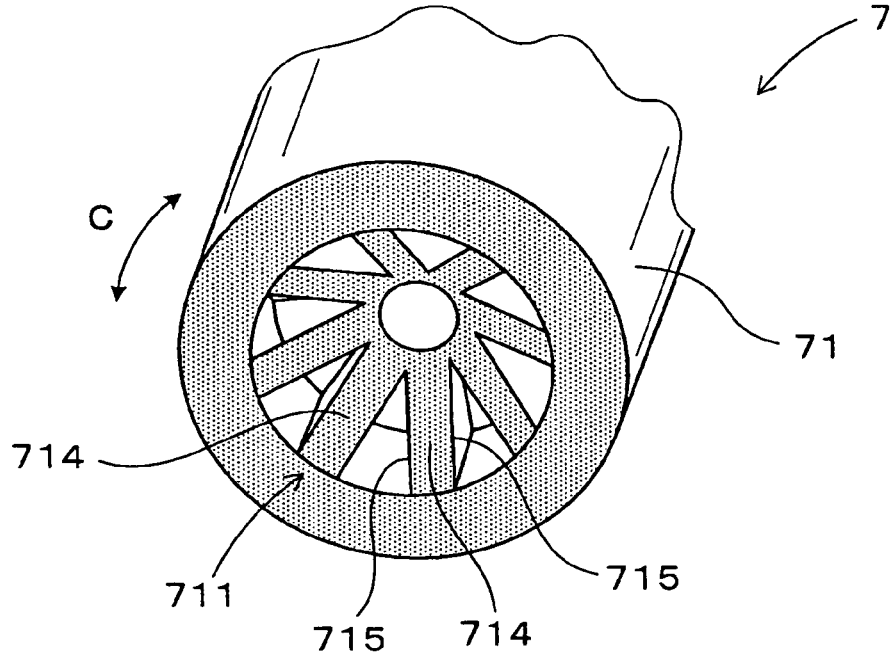
FIG. 25 is a perspective view showing a folding jig according to the fourth embodiment.

As shown in FIG. 25, the folding jig 71 of the manufacturing apparatus 7 for manufacturing the ignition coil 1 according to the present embodiment includes protruding tilted surfaces 714, which are provided at multiple points, respectively, of the recessed processing portion 711, which are arranged one after another in the circumferential direction C. Each protruding tilted surface 714 has a tilted configuration for radially inwardly urging the axially projecting portion 58 of the sheet 8 and is formed to extend linearly from the center of the recessed processing portion 711 in a radially outward direction. Furthermore, each protruding tilted surface 714 has two crease forming blades (crease forming edges) 715 at its circumferential edges to form creases 611.

Figure 26:
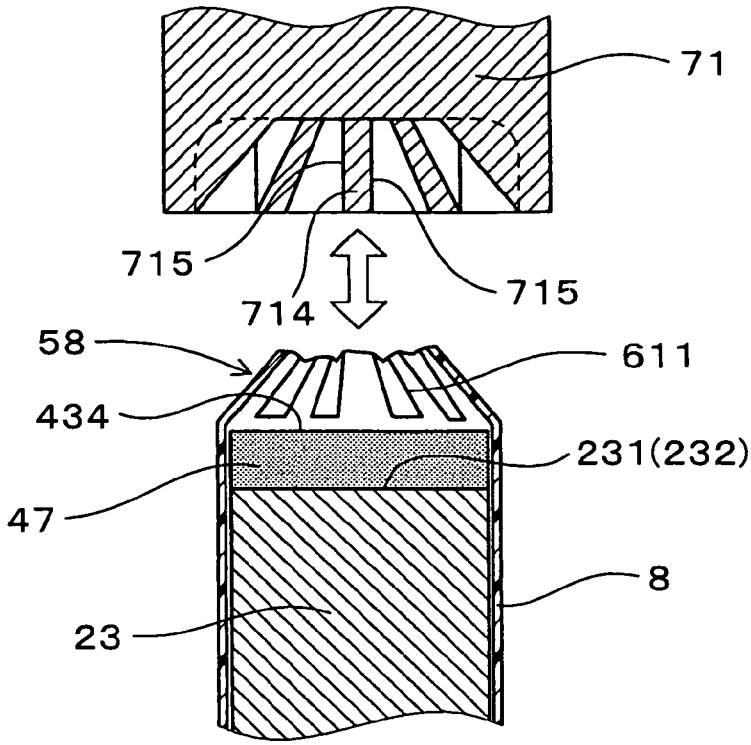
FIG. 26 is a cross sectional view showing a state where creases are provided in an axially projecting portion of the sheet in a folding step according to the fourth embodiment.

As shown in FIG. 26, in the folding step of the manufacturing method of the ignition coil 1 according to the present embodiment, the crease forming blades 715 proved to the circumferential edges of each protruding tilted surface 714 form the creases 611 at the axially projecting portion 58 of the sheet 8.

Figure 27:
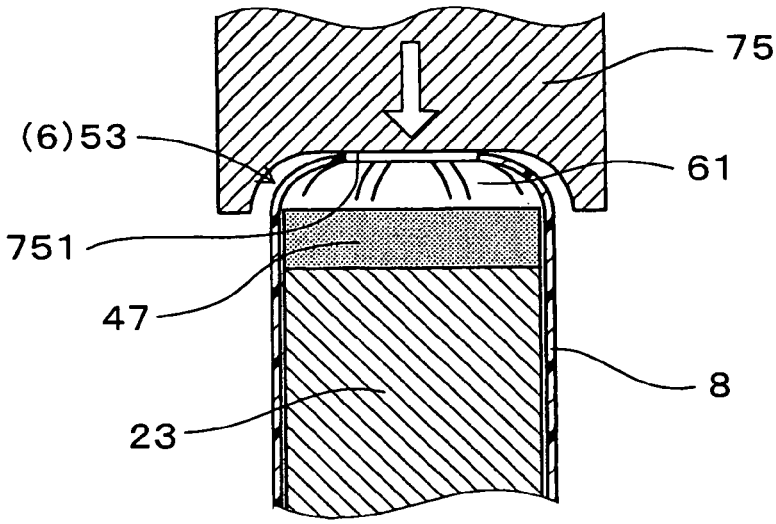
FIG. 27 is a cross sectional view showing a state where a folded end portion is formed in the sheet in a welding step according to the fourth embodiment.
Figure 28:
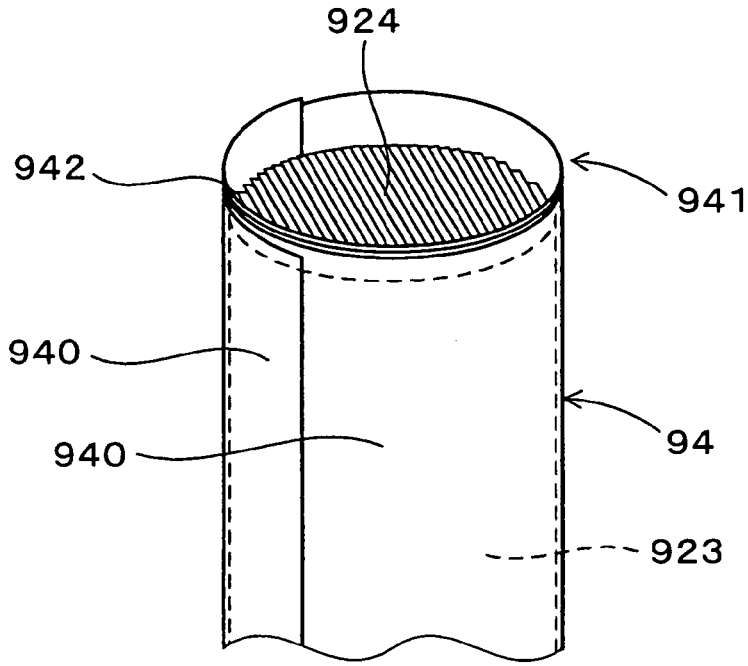
FIG. 28 RELATED ART
FIG. 28 is a perspective view showing a state where steps are formed in layered axial end portions of a dielectric sheet wound around an outer peripheral surface of a central core in a previously proposed art.
Figure 29:
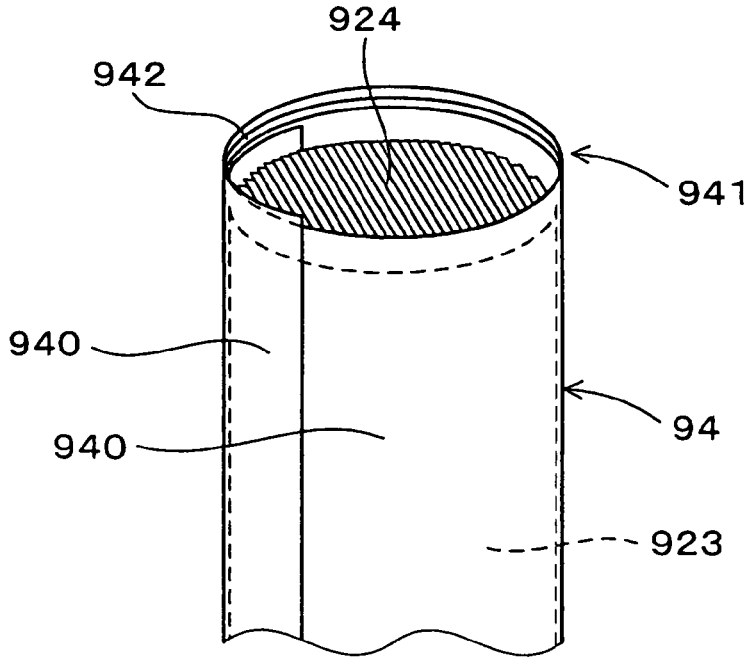
FIG. 29 RELATED ART
FIG. 29 is a perspective view showing a state where steps are formed in layered axial end portions of a dielectric sheet wound around an outer peripheral surface of a central core in another previously proposed art.
Figure 30:
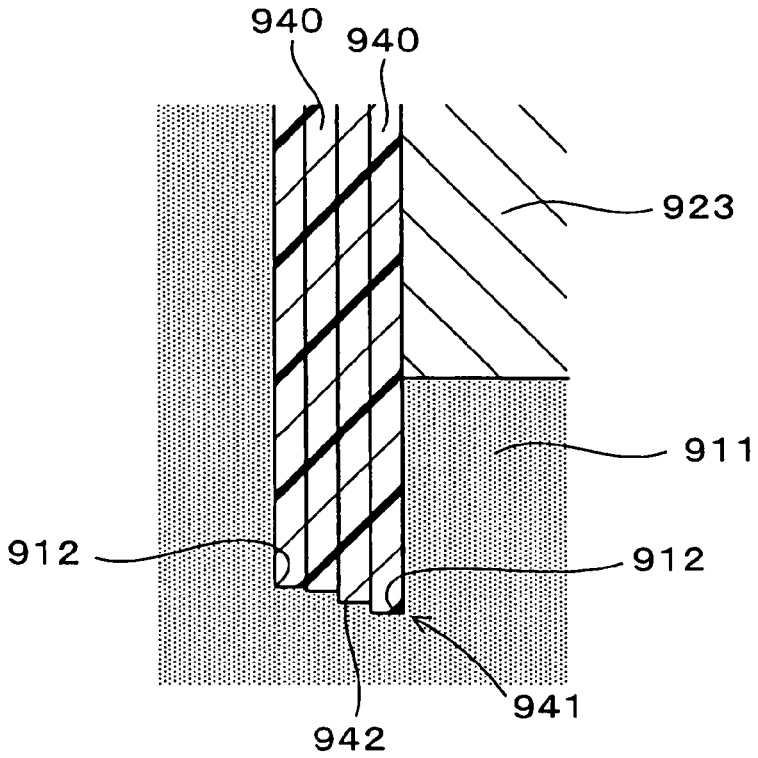
FIG. 30 RELATED ART
FIG. 30 is a cross sectional view showing edged grooves formed in a dielectric resin in the previously proposed art.
Figure 31:
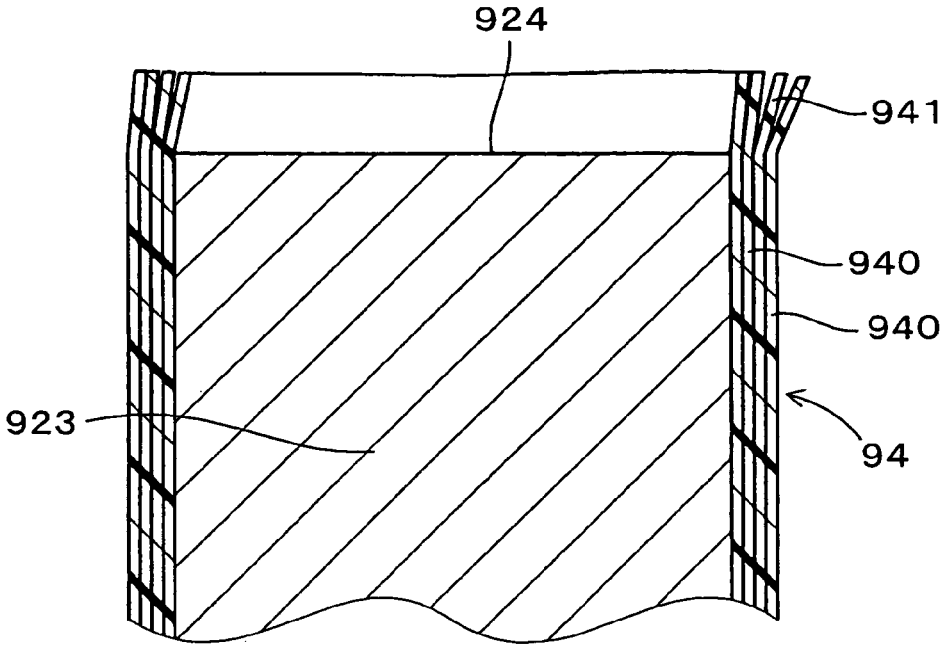
FIG. 31 RELATED ART
FIG. 31 is a cross sectional view showing a state where an excess region of an axial end portion of a dielectric sheet is mechanically cut with a cutting blade in another previously proposed art.
Figure 32:
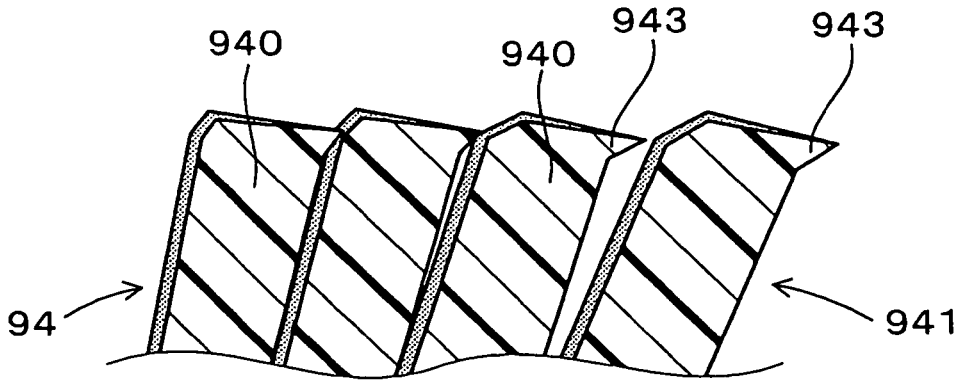
FIG. 32 RELATED ART
FIG. 32 is a cross sectional view showing a state where sharp corners are formed at the axial end portion of the dielectric sheet after the cutting by the cutting blade in the previously proposed art.
Figure 33:
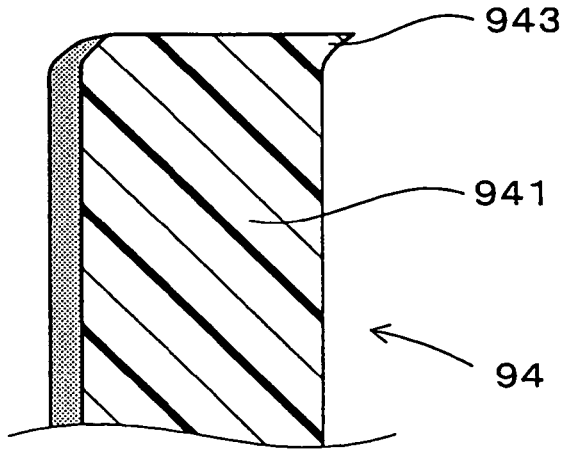
FIG. 33 RELATED ART
FIG. 33 is a cross sectional view showing a state where a sharp corner is formed at an axial end portion of a dielectric sheet after cutting by a cutting blade in another previously proposed art.
Figure 34:
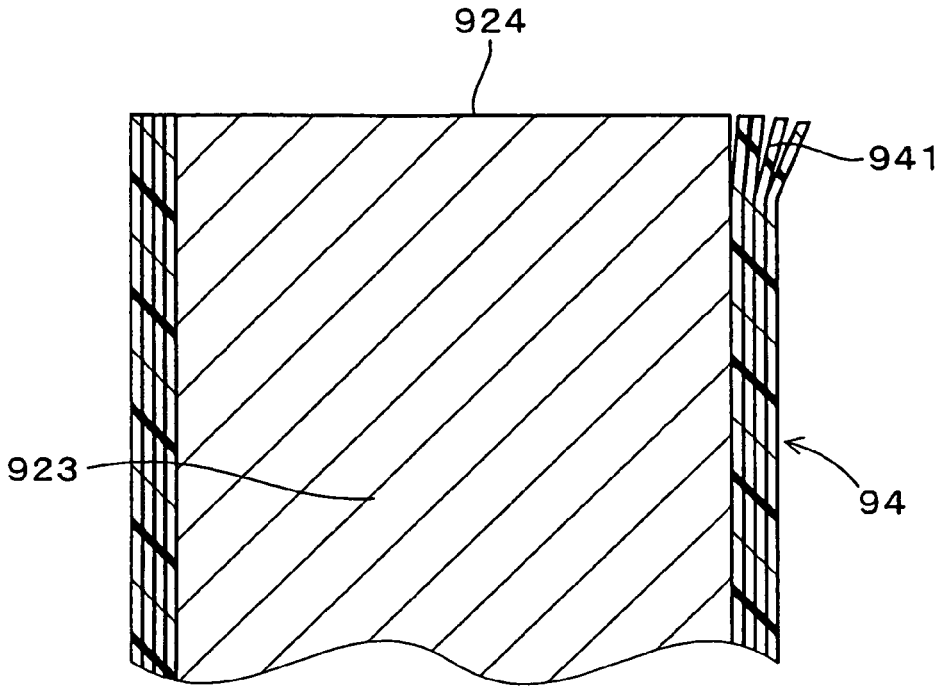
FIG. 34 RELATED ART
FIG. 34 is a cross sectional view showing a state where an excess region of an axial end portion of a dielectric sheet is mechanically cut with a cutting blade along an end surface of a central core in another previously proposed art.
Figure 35:
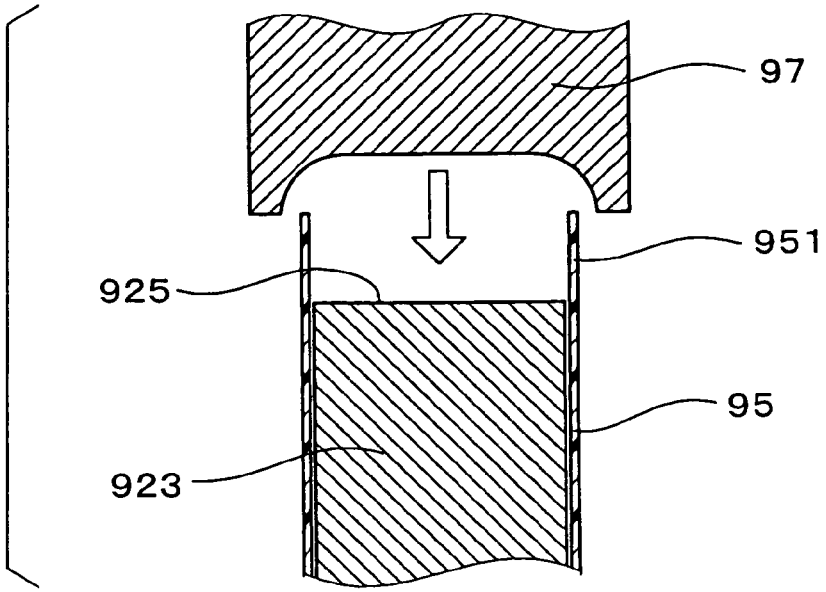
FIG. 35 RELATED ART
FIG. 35 is a cross sectional view showing a state before folding an axial end portion of a sheet in a previously proposed art.
Figure 36:
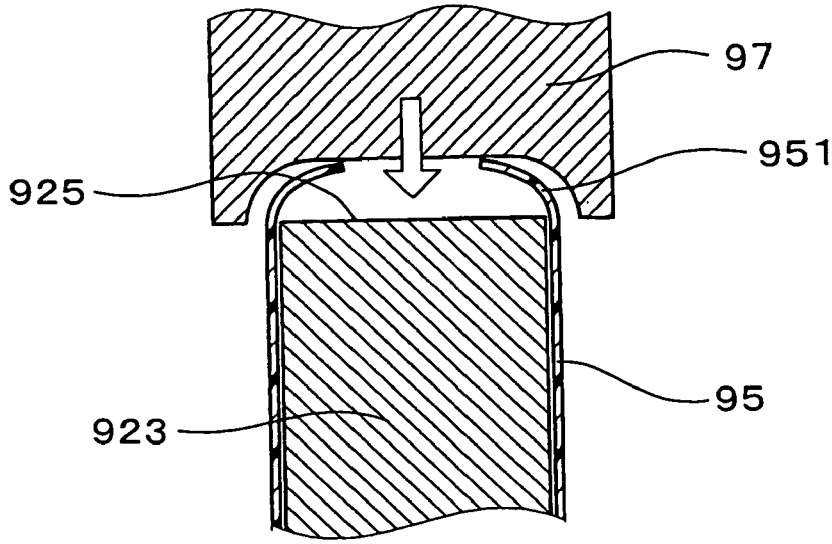
FIG. 36 RELATED ART
FIG. 36 is a cross sectional view showing a state at the time of folding the axial end portion of the sheet in the previously proposed art.
Figure 37:
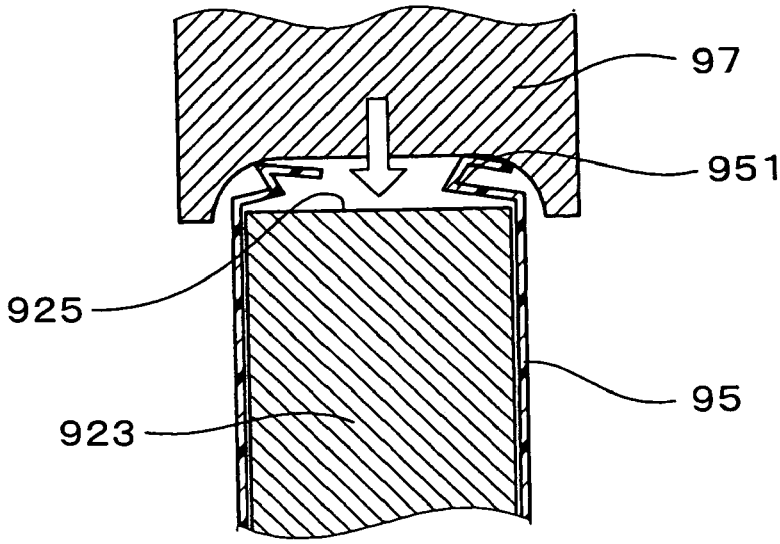
FIG. 37 RELATED ART
FIG. 37 is a cross sectional view showing a state where buckling or deformation occurs in the axial end portion of the sheet in the previously proposed art.

Furthermore, as shown in FIG. 27, in the welding step of the present embodiment, it is possible to form the folded end portion 6, in which the bottom side segments 61A and the top side segments 61B are alternately arranged in the circumferential direction, and each top side segment 61B is folded over its adjacent bottom side segments 61A. Furthermore, in the thus produced folded end portion 6, the multiple arcuate segments 61 are thermally welded together at the overlapped points between the multiple arcuate segments 61.

The fourth embodiment also provides other advantages, which are similar to those discussed above in the third embodiment.

Additional advantages and modifications will readily occur to those skilled in the art. The invention in its broader terms is therefore not limited to the specific details, representative apparatus, and illustrative examples shown and described. Furthermore, any one or more components of any one of the above embodiments can be combined with any one or more components of any other one of the above embodiments. For instance, the folded end portion of the dielectric sheet of the third or fourth embodiment can be implemented in the dielectric sheet of the first or second embodiment. Also, the manufacturing method and the manufacturing apparatus of the third or fourth embodiments may be applied to the first or second embodiment.

What is claimed is:

1. An ignition coil comprising:

primary and secondary coils;

a case that receives the primary and secondary coils;

a central core that is made of a magnetic material and is positioned radially inward of the primary and secondary coils;

a sheet that relieves a thermal stress and is wound around the central core, wherein:

at least one of axial end portions of the sheet forms a folded end portion, which is folded against a corresponding axial end surface of the central core or an axially outer end surface of a connecting member connected to the corresponding axial end surface of the central core;

the folded end portion includes a plurality of generally arcuate segments, which are folded one after another on one circumferential side thereof;

a first circumferential end and a second circumferential end of each generally arcuate segment are folded in such a manner that the first circumferential end of the generally arcuate segment is folded over a second circumferential end of an adjacent one of the plurality of generally arcuate segments located on a first circumferential end side of the generally arcuate segment, and the second circumferential end of the generally arcuate segment is folded beneath a first circumferential end of another adjacent one of the plurality of generally arcuate segments located on a second circumferential end side of the generally arcuate segment; and thermoset resin that is filled in spaces in the case.

2. The ignition coil according to claim 1, wherein the sheet is made of polyethylene terephthalate.

3. The ignition coil according to claim 1, wherein each of the axial end portions of the sheet forms the folded end portion.

4. The ignition coil according to claim 1, wherein only one of the axial end portions of the sheet forms the folded end portion.

5. The ignition coil according to claim 1, wherein the sheet is wound multiple times around the central core.

* * * * *